US009016183B2

(12) United States Patent
Sugie

(10) Patent No.: US 9,016,183 B2
(45) Date of Patent: Apr. 28, 2015

(54) SHEET MATERIAL PUNCHING DEVICE

(71) Applicant: Ricoh Elemex Corporation, Chikusa-ku, Nagoya, Aichi (JP)

(72) Inventor: Naoki Sugie, Nagoya (JP)

(73) Assignee: Ricoh Company, Ltd., Tokyo (JP)

( * ) Notice: Subject to any disclaimer, the term of this patent is extended or adjusted under 35 U.S.C. 154(b) by 252 days.

(21) Appl. No.: 13/763,875

(22) Filed: Feb. 11, 2013

(65) Prior Publication Data

US 2013/0206829 A1 Aug. 15, 2013

(30) Foreign Application Priority Data

Feb. 15, 2012 (JP) ..... 2012-030165

(51) Int. Cl.

| | |
|---|---|
| ***B26F 1/04*** | (2006.01) |
| ***B26F 1/00*** | (2006.01) |
| ***B26D 5/16*** | (2006.01) |
| ***B26F 1/02*** | (2006.01) |

(52) U.S. Cl.

CPC ... *B26F 1/00* (2013.01); *B26F 1/04* (2013.01); *B26D 5/16* (2013.01); *B26F 1/0092* (2013.01); *B26F 1/02* (2013.01)

(58) Field of Classification Search

CPC ..... B26F 1/02; B26F 1/04
USPC ..... 83/687, 691, 571–573; 234/117, 119
See application file for complete search history.

(56) References Cited

U.S. PATENT DOCUMENTS

| | | | | |
|---|---|---|---|---|
| 3,668,821 | A * | 6/1972 | Benson et al. | 53/517 |
| 6,622,908 | B2 * | 9/2003 | Fukumoto et al. | 234/98 |
| 8,770,078 | B2 * | 7/2014 | Baba et al. | 83/618 |
| 2001/0049990 | A1 * | 12/2001 | Takaishi et al. | 83/628 |
| 2008/0264226 | A1 * | 10/2008 | Iguchi | 83/588 |
| 2013/0343796 | A1 * | 12/2013 | Hotta | 399/408 |

FOREIGN PATENT DOCUMENTS

| | | | |
|---|---|---|---|
| JP | 2008137099 | | 6/2008 |
| JP | 2008137099 | A * | 6/2008 |

OTHER PUBLICATIONS

English translation of JP2008-137099 published Jun. 19, 2008. (Translation was done by a machine).

* cited by examiner

*Primary Examiner* — Ned Landrum
*Assistant Examiner* — Richard Crosby, Jr.
(74) *Attorney, Agent, or Firm* — Thomas | Horstemeyer, LLP

(57) ABSTRACT

A sheet material punching device includes a plurality of punches and links, a driving mechanism having drive gears capable of transmitting a rotational driving force of an electric motor (driving source), and slide arms allowed to reciprocate along the longitudinal direction of a frame, the slide arms making the punches reciprocate in a punching direction along with their own reciprocating motions by the intermediary of links. The slide arms respectively have cams capable of converting the rotational motion of the driving mechanism into the reciprocating motions of the slide arms, and auxiliary cams capable of moving the slide arms to predefined initial positions. The drive gears respectively have cam followers to be engaged with the cams, and auxiliary cam followers to be engaged with the auxiliary cams. The sheet material punching device return the slide arms to the initial positions without increasing a driving energy.

10 Claims, 19 Drawing Sheets

The slide arm 51does not reciprocate

SHEET MATERIAL PUNCHING DEVICE

BACKGROUND OF THE INVENTION

1. Field of the Invention

This invention relates to a sheet material punching device, more particularly to a sheet material punching device used in a finisher that performs post-treatments to a sheet of paper transported from an image formation apparatus.

2. Background Art

For example, the sheet material punching device disclosed in the Patent Document 1 has a plurality of punches provided in the longitudinal direction of a frame and die holes formed correspondingly to the plurality of punches, wherein the rotational motion of a driving mechanism is converted by a cam mechanism into reciprocating motions of the plurality of punches in a punching direction. The plurality of punches and the die holes jointly form an array of holes in a sheet material.

The sheet material punching device disclosed in the Patent Document 1 includes: two slide arms allowed to reciprocate along the longitudinal direction of the frame, the two slide arms making the plurality of punches reciprocate in the punching direction along with their own reciprocating motion by the intermediary of a plurality of links; cams provided in the respective slide arms, the cams having cam grooves capable of converting the rotational motion of the driving mechanism into the reciprocating motions of the slide arms; and cam followers provided, for example, in a drive gear, to be engaged with the cam grooves, wherein an array of holes to be formed by the plurality of punches is changed by switching the reciprocating motion of one of the slide arms to the reciprocating motion of the other.

In the sheet material punching device of this type, as illustrated in, for example, FIG. 20A, there is an interval T between a cam follower 202*a* provided in a drive gear 202 and a cam groove 201*a* provided in a slide arm 201 which is one of slide arms, a slide arm 201, is at an initial position. The interval T is formed in a predefined dimension so that a large operating resistance is not generated during an initial drive of a driving source, for example. Because of the interval, the slide arm 201 does not start to move forward in the reciprocating motion immediately after the drive gear 202 starts to rotate clockwise on the drawing.

After the slide arm 201 is reciprocated; moved forward (FIGS. 20B and 20C) and then moved backward (FIG. 20D), the cam follower 202*a* further slightly rotates from an initial position illustrated in FIG. 20A toward an inverted position through 180° (FIG. 20E) clockwise on the drawing. While the cam follower 202*a* is moving from the position illustrated in FIG. 20D toward the inverted position illustrated in FIG. 20E, the slide arm 201 does not follow the movement of the cam follower 202*a*. Therefore, the slide arm 201 fails to return to the initial position illustrated in FIG. 20A. This consequently shortens the reciprocating distance of the slide arm 201, causing unfavorable events. For example, the holes may not be formed in the sheet, or the punches may fail to punch through the sheet.

To avoid these problems, the sheet material punching device disclosed in the Patent Document 1 is provided with a tension spring 204, which is a biasing member, between a frame 203 and the slide arm 201 as illustrated in FIGS. 20F to 20H. The tension spring 204 constantly keeps biasing the slide arm 201 in a direction where the slide arm 201 moves back to the initial position. As a result, the slide arm 201 that ended the backward movement of the reciprocating motion (FIG. 20F) can still follow the movement of the cam follower 202*a* and accordingly return to the initial position (FIG. 20G).

PRIOR ART DOCUMENT

Patent Document

[Patent Document 1] Japanese Unexamined Patent Application Publication No. 2008-137099

SUMMARY OF THE INVENTION

Problems to be Solved by the Invention

According to the sheet material punching device, the spring constant of the tension spring 204 is often set to a large value to ensure that the slide arm 201 can return to the initial position when punching holes in a sheet material where a punching load is high due to a thickness dimension, a degree of hardness and the like thereof or where a large friction is generated between the sheet material and the punches. However, such a large spring constant of the tension spring 204 increases a driving load required for the reciprocating motion of the slide arm 201. This makes it necessary that the driving performance of the driving source be increased, thereby resulting in a larger driving source and a higher driving energy.

The invention has an object to prevent the driving energy of the driving source from increasing and provide an inexpensive and structurally simplified mechanism for returning the slide arm to its initial position.

Means for Solving Problems

To accomplish the object, a sheet material punching device according to the invention includes:

a plurality of punches provided in a longitudinal direction of a frame;

a driving mechanism having a drive gear capable of transmitting a rotational driving force of a driving source;

a slide arm allowed to reciprocate along the longitudinal direction of the frame, the slide arm making the plurality of punches reciprocate in a punching direction along with the own reciprocating motion;

a cam provided in the slide arm, the cam being capable of converting a rotational motion of the driving mechanism into the reciprocating motion of the slide arm;

a cam follower provided in the drive gear or a rotary member that rotates integrally with the drive gear to be engaged with the cam;

an auxiliary cam provided in the slide arm, the auxiliary cam being capable of moving the slide arm to a predefined initial position by converting the rotational motion of the driving mechanism into a backward movement in the reciprocating motion of the slide arm; and an auxiliary cam follower provided in the drive gear or the rotary member that rotates integrally with the drive gear to be engaged with the auxiliary cam.

For the sheet material punching device according to the invention, the auxiliary cam and the auxiliary cam follower are engaged with each other and thereby the rotational motion of the driving mechanism is converted into the backward movement in the reciprocating motion of the slide arm. As a result, the slide arm returns to the predefined initial position. By thus leveraging the rotational motion of the driving mechanism to return the slide arm to the initial position, it becomes unnecessary to provide a biasing member to return so. This reduces the driving load required for the reciprocating motion of the slide arm, thereby effectively preventing the driving energy of the driving source from increasing. Another advantage is that the combination of the auxiliary cam and the auxiliary cam follower constitutes the mechanism for returning the slide arm to the initial position. Such a mechanism can be structurally simplified and inexpensively provided.

EMBODIMENTS OF THE INVENTION

Figure 1:
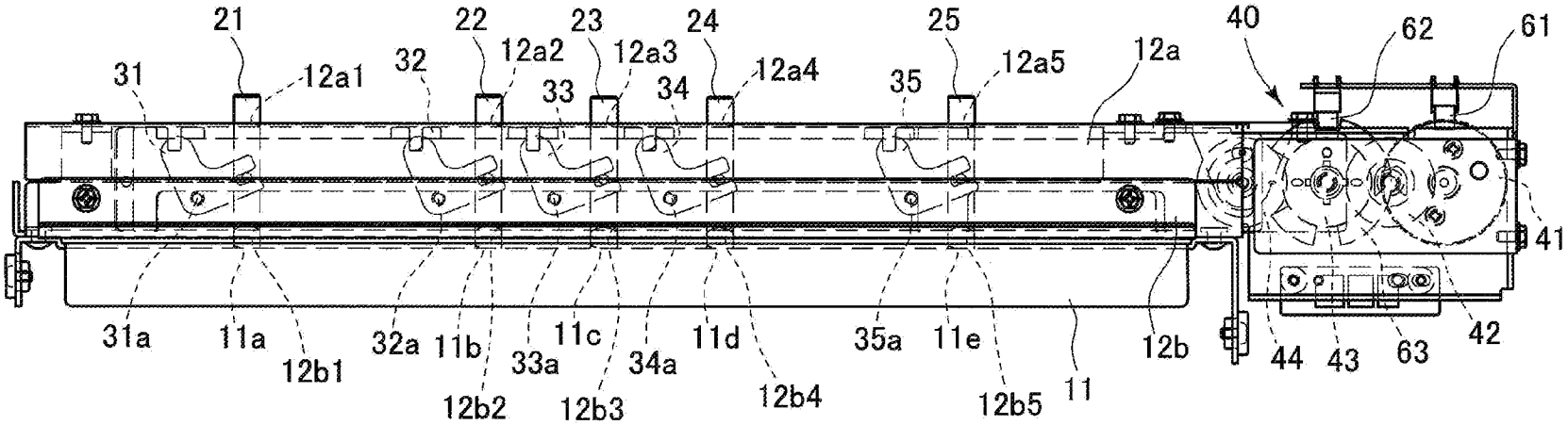
FIG. 1 is a front view of a sheet material punching device according to the first embodiment of the invention.
Figure 2:
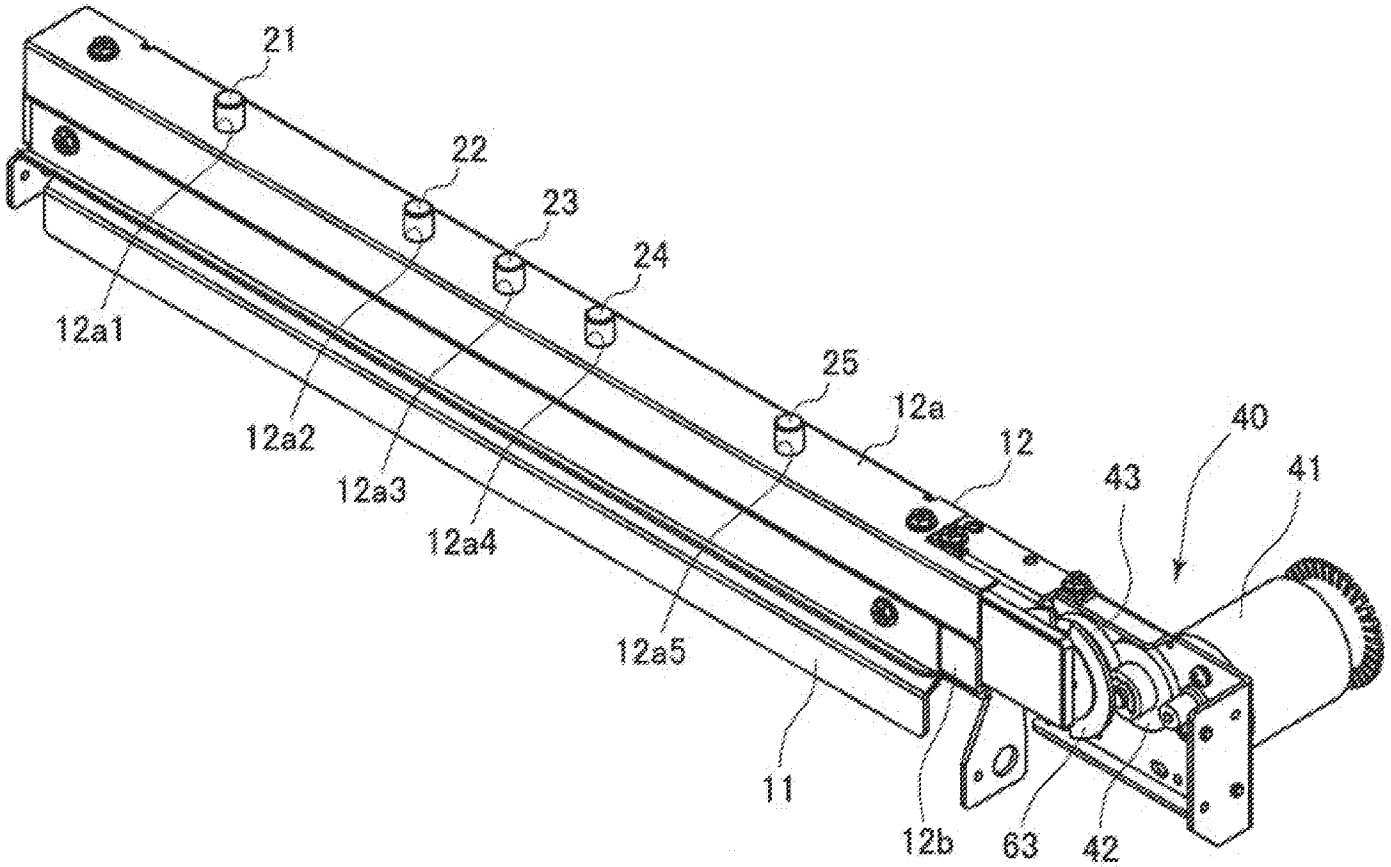
FIG. 2 is an external view of the sheet material punching device illustrated in FIG. 1 from which a sensor bracket has been removed.
Figure 3:
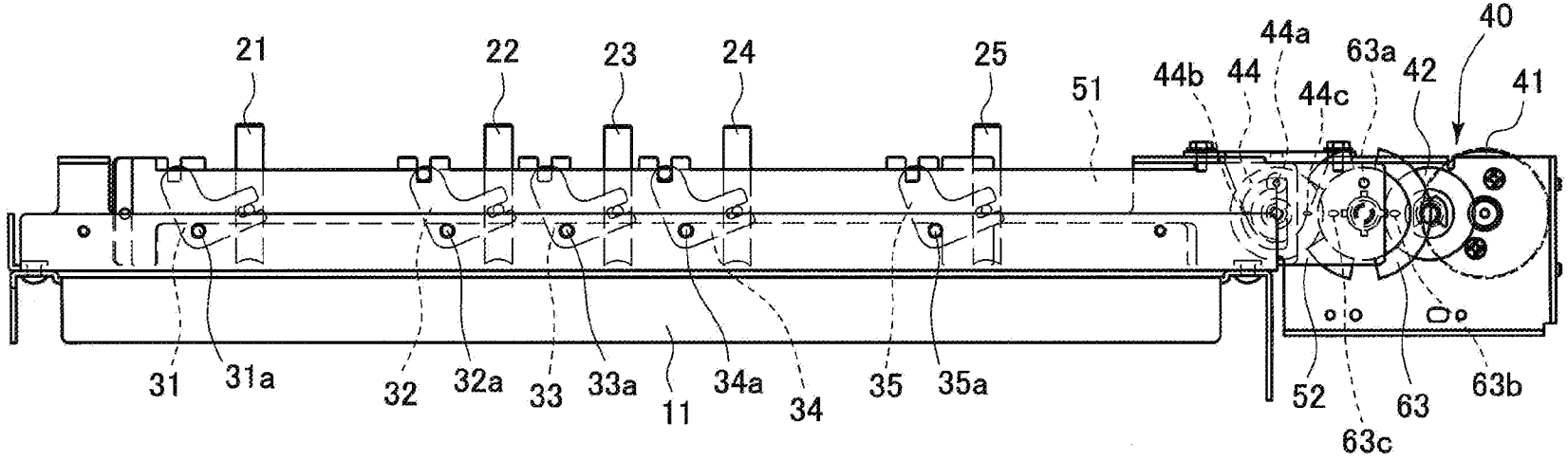
FIG. 3 is a front view of the sheet material punching device illustrated in FIG. 2 from which a frame cover has been removed.
Figure 4:
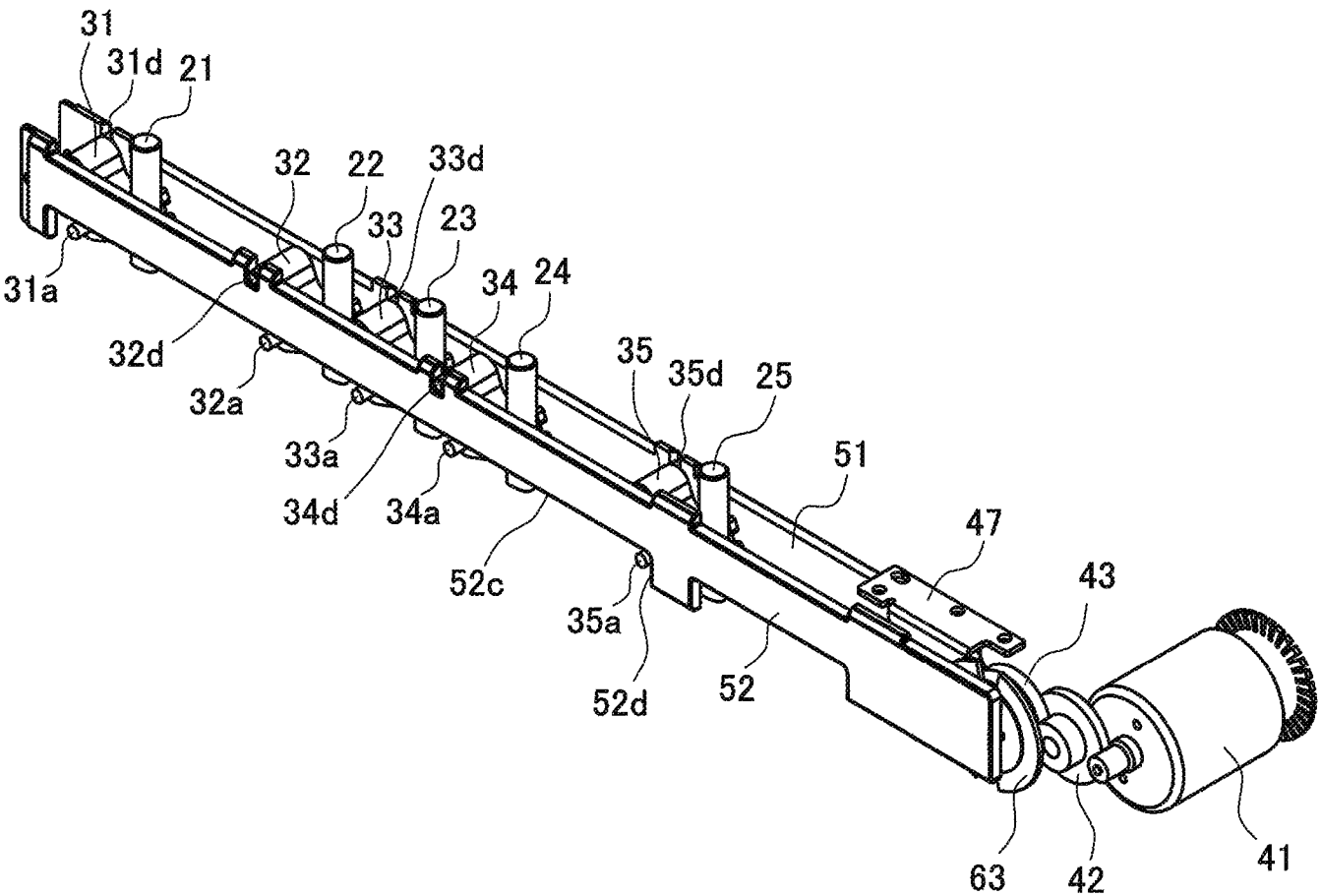
FIG. 4 is an external view of the sheet material punching device illustrated in FIG. 3 from which a frame body and a die frame have been removed.

Hereinafter, embodiments of the invention are described referring to the accompanied drawings.

Embodiment 1

FIGS. 1 to 7 illustrate an external view of a sheet material punching device according to the invention which is used in a finisher of an image formation apparatus and structural elements of the device. The sheet material punching device includes an elongated die frame 11 formed in a U-like shape and having a plurality of die holes 11*a* to 11*e*, and an elongated frame 12 formed in a rectangular tubular shape where punches 21 to 25, links 31 to 35, a driving mechanism 40, and slide arms 51 and 52 are assembled therein. The die frame 11 and the frame 12 are secured to each other by bending the die frame 11 so as to be arranged in an opposed manner with a predefined interval therebetween, though which a sheet material is to be inserted. The interval can be formed by interposing an interval formation plate member.

The die holes 11*a* to 11*e* are formed so as to respectively correspond to the punches 21 to 25. An array of three holes spaced at a predefined pitch is formed in the sheet material by reciprocation of the punches 21, 23, and 25 with respect to the die holes 11*a*, 11*c*, and 11*e*. Further, an array of two holes spaced at a predefined pitch is formed in the sheet material by reciprocation of the punches 22 and 24 with respect to the die holes 11*b* and 11*d*.

Two vertically separate parts, a cover 12*a* and a frame body 12*b*, constitute the frame 12. The cover 12*a* and the frame body 12*b* respectively have guide holes 12*a*1 to 12*a*5 and 12*b*1 to 12*b*5 coaxially with the die holes 11*a* to 11*e* of the die frame 11. The punches 21 to 25, being guided by the guide holes 12*a*1 to 12*a*5 and 12*b*1 to 12*b*5 vertically distant from each other, reciprocate in a punching direction.

Figure 5:
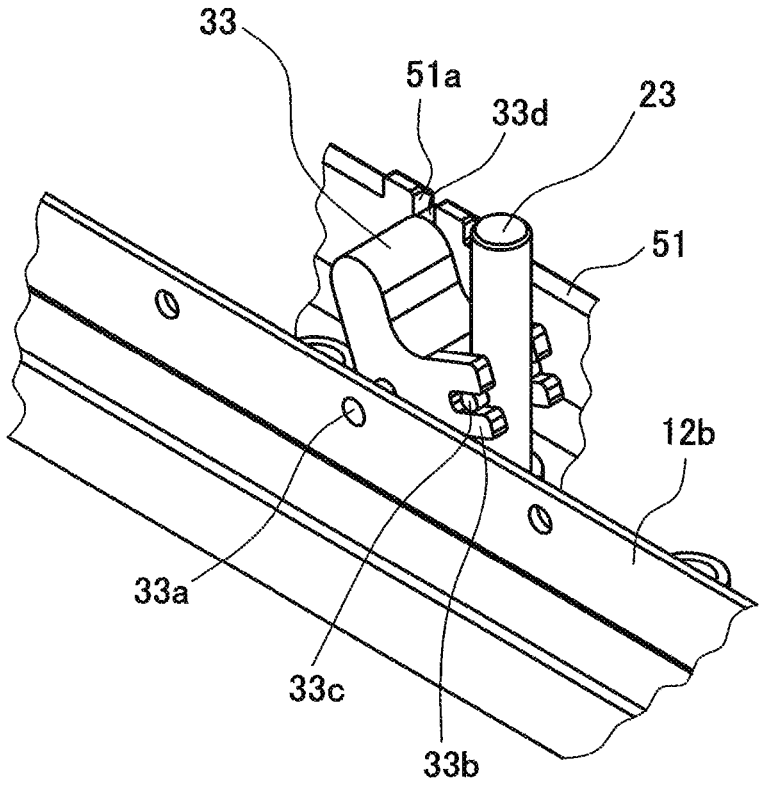
FIG. 5 is a partly enlarged view of the sheet material punching device illustrated in FIG. 4.

The links 31 to 35 are formed in a substantially L-like shape in front view. One of the links, link 33, is illustrated in FIG. 5. These links 31 to 35 are supported to the frame body 12*b* at intermediate sections thereof by support pins 31*a* to 35*a* so as to rotate around the pins 31*a* to 35*a*. The links 31 to 35 have bifurcated arm portions 31*b* to 35*b* on one ends thereof. The links 31 to 35 are coupled with the punches 21 to 25 by the bifurcated arm portions 31*b* to 35*b* with punch support pins 31*c* to 35*c* fitted therein.

Of the links 31 to 35, the links 31, 33, and 35 (a first group of links) have arm engaging pins 31*d*, 33*d*, and 35*d* on the other ends thereof in a protruding manner toward the slide arm 51. The links 31, 33, and 35 are coupled with coupling portions 51*a* of the slide arm 51 with the arm engaging pins 31*d*, 33*d*, and 35*d* fitted therein. Of the links 31 to 35, the links 32 and 34 (a second group of links) have arm engaging pins 32*d* and 34*d* on the other ends thereof in a protruding manner toward the slide arm 52. The links 32 and 34 are coupled with coupling portions 52*a* of the slide arm 52 with the arm engaging pins 32*d* and 34*d* fitted therein.

With the slide arm 51 reciprocating, the links 31, 33, and are rotated around the support pins 31*a*, 33*a*, and 35*a*. Accordingly, the punches 21, 23, and 25 (a first group of punches) are reciprocated in the punching direction. With the slide arm 52 reciprocating, the links 32 and 34 are rotated around the support pins 32*a* and 34*a*. Accordingly, the punches 22 and 24 (a second group of punches) are reciprocated in the punching direction.

A driving mechanism 40 has an electric motor 41 (driving source), and a reduction gear 42, a drive gear 43 (second drive gear), and a drive gear 44 (first drive gear) which are gear-joined with the electric motor 41 so as to respectively rotate around respective different axes. A rotational driving force generated by the electric motor 41 is transmitted to the drive gear 44 through the reduction gear 42 and then the drive gear 43.

An example of the electric motor 41 is a DC brush motor. The number of rotations (rotational amount) required for punching holes is detected by a sensor filler 63 and a home position sensor 62 mounted integrally with the drive gear 43. The operation of the electric motor 41 is controlled by an electronic control unit (ECU) not illustrated so that a speed of rotation is suitably adjusted in response to pulses detected by a pulse count sensor 61.

Figure 8A:
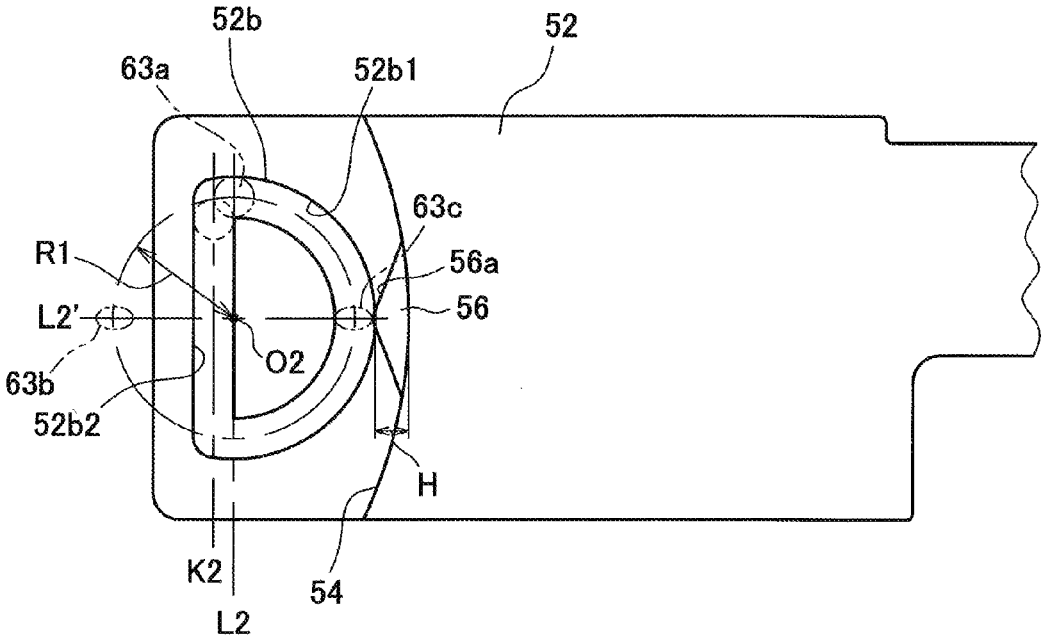
FIG. 8A is a partial front view of a slide arm 52.
Figure 10:
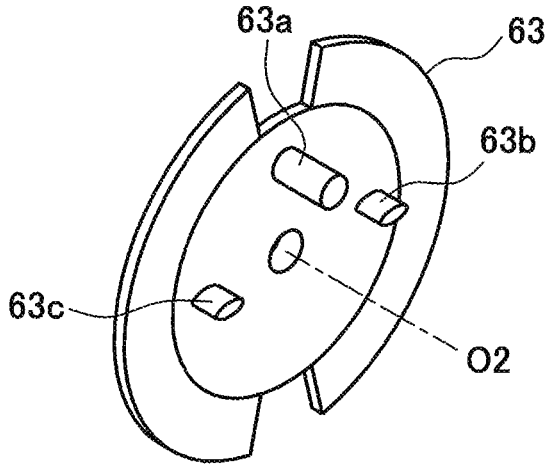
FIG. 10 is an external view of a sensor filler 63.

The drive gear 43 is mounted on the frame body 12*b* via a stud shaft disposed at a position where any interference with the slide arms 51 and 52 is avoided. The drive gear 43 has a sensor filler 63 (rotary member) integrally mounted thereto. The sensor filler 63, in cooperation with the home position sensor 62, detects a direction of rotation and home positions (two reference positions, an initial position and a position rotated through 180° from the initial position (hereinafter, may be referred to as inverted position)) of the drive gear 43. As illustrated in FIG. 8A and the like, and FIG. 10, a cam-side engaging pin 63*a* (second cam follower) is provided on an outer-side surface of the sensor filler 63 in a protruding manner toward an inner-side surface of the slide arm 52.

The outer-side surface of the sensor filler 63 is further provided with auxiliary-cam-side engaging pins 63*b* and 63*c* (second auxiliary cam followers) in a protruding manner. The auxiliary-cam-side engaging pins 63*b* and 63*c* are point symmetry (diagonal) with respect to an axis of rotation O2. The cam-side engaging pin 63*a* is formed in a columnar shape with a circular cross section. The auxiliary-cam-side engaging pins 63*b* and 63*c* are formed in a columnar shape with an elliptical cross section in which a major axis of the elliptical shape corresponds to the diameter of the cam-side engaging pin 63*a*.

The cam-side engaging pin 63*a* and the auxiliary-cam-side engaging pins 63*b* and 63*c* are located on a circumference centering on the axis of rotation O2 (radius of rotation R1, see FIG. 8A). Based on the clockwise direction around the axis of rotation O2 in front view of the sensor filler 63 illustrated in FIG. 10, the auxiliary-cam-side engaging pin 63*b* is located at a position having a phase advanced through 90° relative to the cam-side engaging pin 63*a*, whereas the auxiliary-cam-side engaging pin 63*c* is located at a position having a phase delayed through 90° relative to the same.

The drive gear 44 and the drive gear 43 have an equal number of teeth. The drive gear 44 is meshed with the drive gear 43 so that two gears 44, 43 rotate in opposite directions with each other, and mounted on the frame body 12*b* by using a bracket 47 disposed at a position where any interference with the slide arms 51 and 52 is avoided. An engaging pin 44*a* (first cam follower) is provided on an inner-side surface of the drive gear 44 in a protruding manner toward an inner-side surface of the slide arm 51.

Figure 9A:
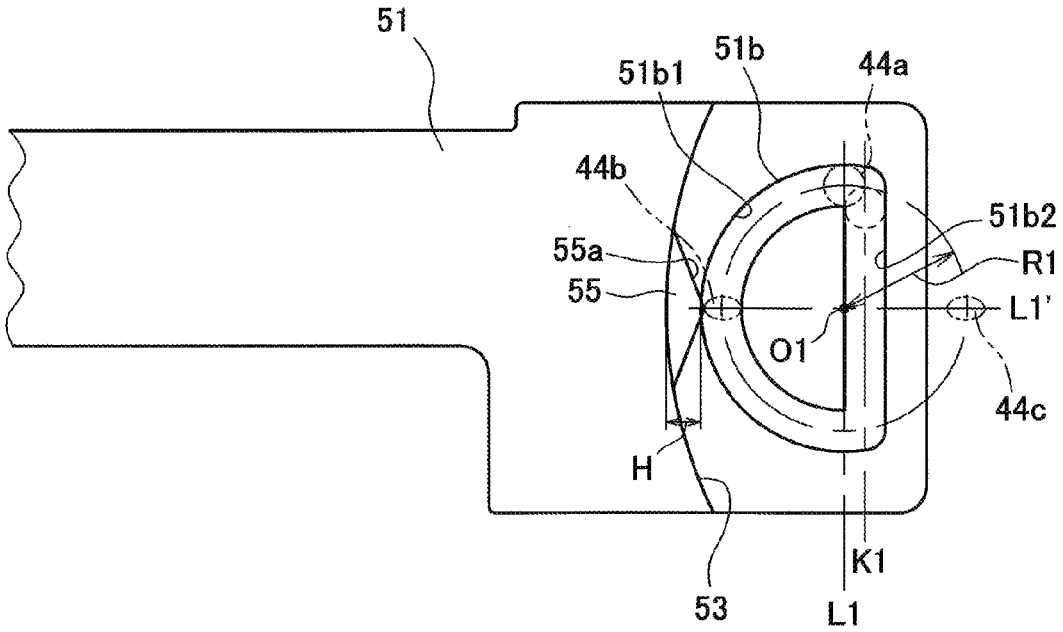
FIG. 9A is a partial front view of a slide arm 51.
Figure 11:
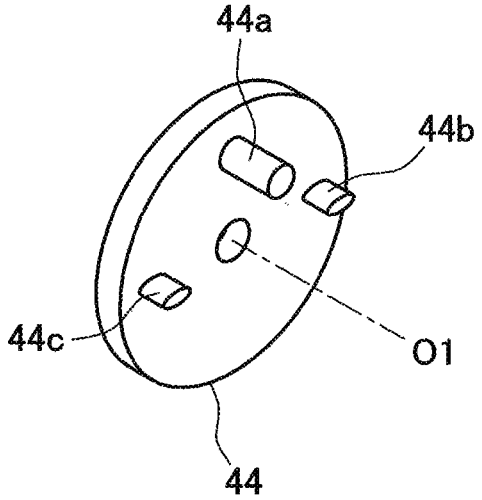
FIG. 11 is an external view of a drive gear 44.

Similarly to the outer-side surface of the sensor filler 63, the inner-side surface of the drive gear 44 is further provided with auxiliary-cam-side engaging pins 44*b* and 44*c* (first auxiliary cam followers) in a protruding manner as illustrated in FIG. 9A and the like, and FIG. 11. The auxiliary-cam-side engaging pins 44*b* and 44*c* are point symmetry (diagonal) with respect to an axis of rotation O1. The cam-side engaging pin 44*a* is formed in a columnar shape with a circular cross section. The auxiliary-cam-side engaging pins 44*b* and 44*c* are formed in a columnar shape with an elliptical cross section, in which a major axis of the elliptical shape corresponds to the diameter of the cam-side engaging pin 44*a*.

The cam-side engaging pin 44*a* and the auxiliary-cam-side engaging pins 44*b* and 44*c* are located on a circumference centering on the axis of rotation O1 (radius of rotation R1, see FIG. 9A). Based on the clockwise direction around the axis of rotation O1 in front view of the inner-side surface of the drive gear 44 illustrated in FIG. 11, the auxiliary-cam-side engaging pin 44*b* is located at a position having a phase advanced through 90° relative to the cam-side engaging pin 44*a*, whereas the auxiliary-cam-side engaging pin 44*c* is located at a position having a phase delayed through 90° relative to the same.

Figure 6:
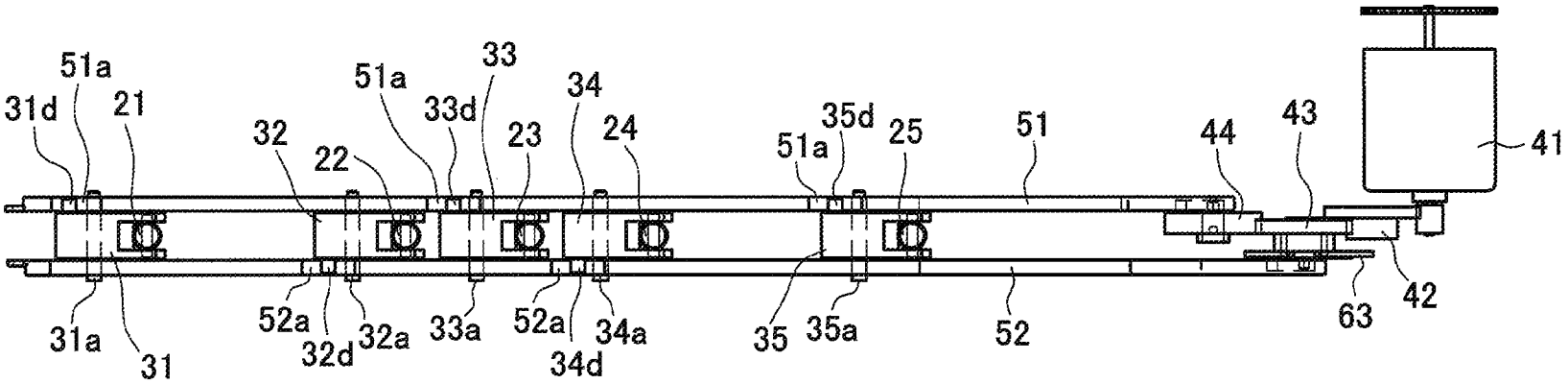
FIG. 6 is a plan view of the sheet material punching device illustrated in FIG. 4 from which a bracket has been removed.
Figure 7:
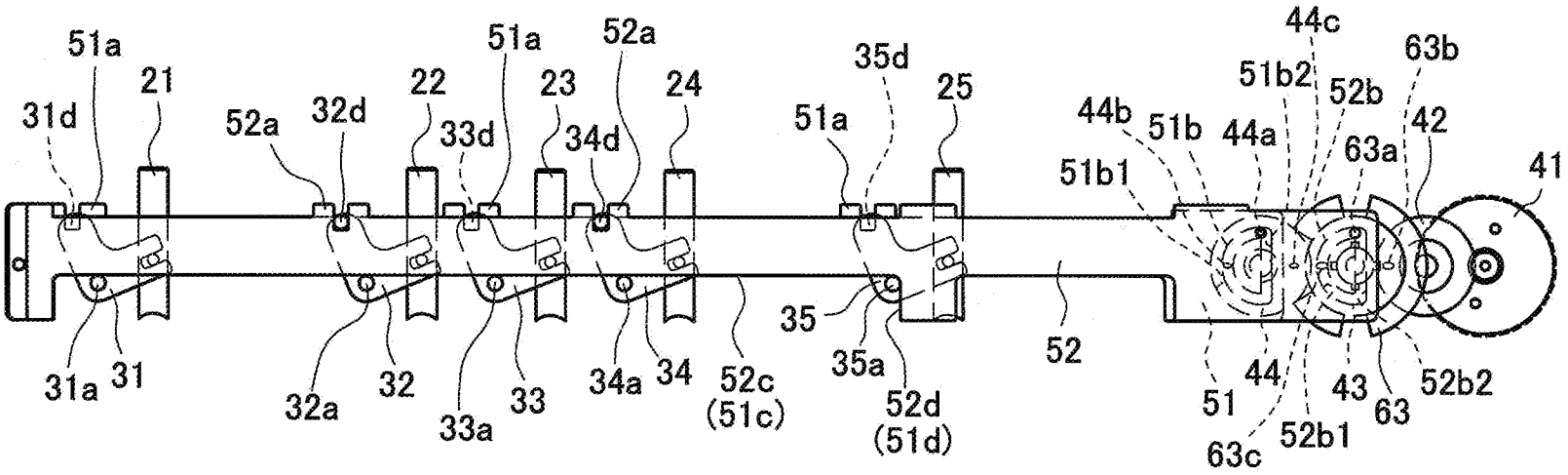
FIG. 7 is a front view of the illustration of FIG. 6.
Figure 8B:
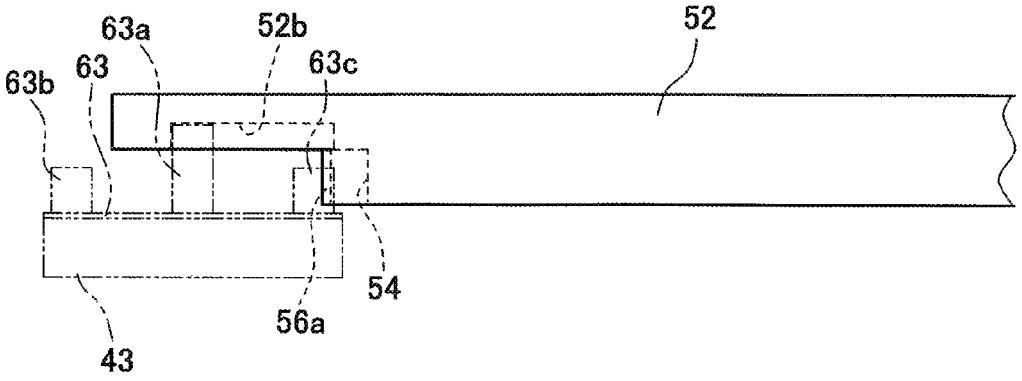
FIG. 8B is a plan view of the illustration of FIG. 8A.
Figure 9B:
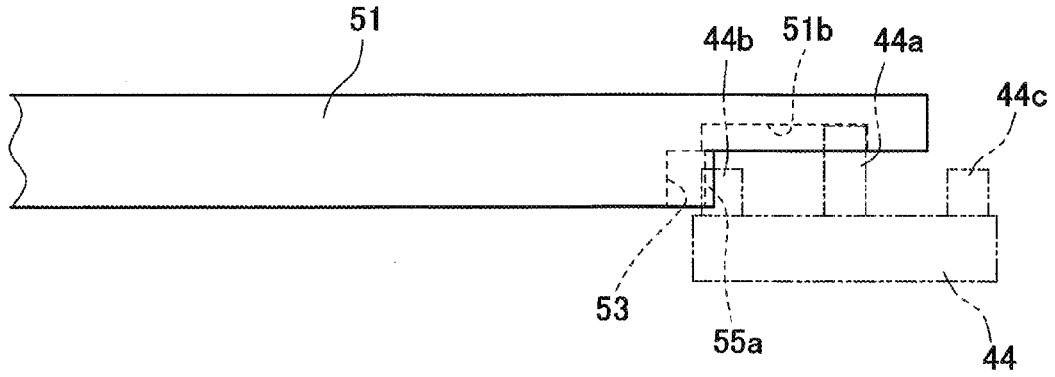
FIG. 9B is a plan view of the illustration of FIG. 9A.

As illustrated in FIGS. 6 and 7, the slide arm 51 (first slide arm) and the slide arm 52 (second slide arm) are elongated plate members having a rectangular shape. The slide arm 51 and the slide arm 52 are configured to reciprocate in opposed manner with the punches 21 to 25 interposed therebetween in the frame body 12*b* along the longitudinal direction of the frame body 12*b*. As illustrated in FIGS. 8 and 9, the slide arms 51 and 52 are each formed in a plate shape with a stepped portion. The slide arms 51 and 52 have a reduced plate thickness at an edge-side than a wall portion 53, 54, compared to at an intermediate-side than a wall portion 53, 54. The slide arms 51 and 52 respectively have cam grooves 51*b* and 52*b* inside at the edge-side.

As illustrated in the front view of FIG. 9A, the cam groove 51*b* (first cam groove) of the slide arm 51 has a width slightly larger than the diameter of the engaging pin 44*a*. Further, the cam groove 51*b* is formed in a substantially reversed D-like shape constituted by a curved groove portion 51*b*1 and a straight groove portion 51*b*2. In the curved groove portion 51*b*1 of the cam groove 51*b* (first arm operation restricting portion), a radius of curvature R1 of a central line thereof is set equal to a radius of rotation R1 of a circular trajectory drawn by the axis of the engaging pin 44*a*.

The straight groove portion 51*b*2 of the cam groove 51*b* (first arm operating portion) has a central line K1 located at a position that is offset toward the opposite side of the curved groove portion 51*b*1 relative to a center of rotational trajectory (axis of rotation) O1 of the engaging pin 44*a*. Therefore, after the engaging pin 44*a* located as illustrated with a broken line in FIG. 9A returns to an initial position illustrated with a two-dot chain line, the axis of the engaging pin 44*a* is located in vicinity of a central line L1 of the drive gear 44 in the vertical direction. This makes it easier to set a rotational reference position of the engaging pin 44*a*.

As long as the engaging pin 44*a* is engaged with the curved groove portion 51*b*1 of the cam groove 51*b*, the slide arm 51 does not reciprocate regardless of any movement of the engaging pin 44*a*. During the engagement of the engaging pin 44*a* with the straight groove portion 51*b*2 of the cam groove 51*b*, the engaging pin 44*a* rotates in a direction where the engagement is retainable, allowing the slide arm 51 to reciprocate in the longitudinal direction thereof.

An auxiliary cam 55 (first auxiliary cam) is provided in a protruding manner on a wall surface of the wall portion 53. The auxiliary cam 55 is located on a central line L1' of the drive gear 44 in the lateral direction. The initial position of the engaging pin 44*a* is set on the central line L1 of the drive gear 44 in the vertical direction, and the auxiliary cam 55 is provided at a position where a central angle is substantially 90° (90°±20°) relative to the initial position. As illustrated in the front view of FIG. 9A, the auxiliary cam 55 is a protrusion where a cam surface 55*a* has a shape of a substantially isosceles-triangle. A height H of the protrusion from the wall portion 53 is set to a value that enables an apex of the triangle to be located substantially on an outer edge of the curved groove portion 51*b*1 of the cam groove 51*b*.

For example, a timing of the engagement between the auxiliary-cam-side engaging pin 44*b*, 44*c* and the auxiliary cam 55 is set as described below. When the slide arm 51 is distant from the initial position during reciprocating, the auxiliary-cam-side engaging pins 44*b* and 44*c* are distant from the auxiliary cam 55. When the slide arm 51 is moved backward to vicinity of the initial position in the reciprocating motion, one of the auxiliary-cam-side engaging pins 44*b* and 44*c* is engaged with the auxiliary cam 55.

Before engaged with the auxiliary cam 55, the auxiliary-cam-side engaging pin 44*b*, 44*c* is engaged with (makes contact with) the wall surface of the wall portion 53. Then, the auxiliary-cam-side engaging pin 44*b*, 44*c*, being guided by the wall surface of the wall portion 53, is engaged with (makes contact with) the cam surface 55*a* corresponding to a side portion of the auxiliary cam 55. The wall surface of the wall portion 53 has an arc shape having a curvature smaller than that of a circular trajectory drawn by the axis of the auxiliary-cam-side engaging pin 44*b*, 44*c*. By initially making the auxiliary-cam-side engaging pin 44*b*, 44*c* contact with the wall surface of the wall portion 53, the auxiliary-cam-side engaging pin 44*b*, 44*c* is prevented from bumping into the auxiliary cam 55. Accordingly, the auxiliary-cam-side engaging pin 44*b*, 44*c* can make a smooth contact with the cam surface 55*a* of the auxiliary cam 55. The wall portion 53 serves as a guide wall according to the invention.

As illustrated in the front view of FIG. 8A, the cam groove 52*b* of the slide arm 52 (second cam groove) has a width slightly larger than the diameter of the engaging pin 63*a*. Further, the cam groove 52*b* is formed in a substantially reversed D-like shape constituted by a curved groove portion 52*b*1 and a straight groove portion 52*b*2, similar to that of the cam groove 51*b*. In the curved groove portion 52*b*1 of the cam groove 52*b* (second arm operation restricting portion), a radius of curvature R1 of a central line thereof is set equal to a radius of rotation R1 of a circular trajectory drawn by the axis of the engaging pin 63*a*.

The straight groove portion 52*b*2 of the cam groove 52*b* (second arm operating portion) has a central line K2 located at a position that is offset toward the opposite side of the curved groove portion 52*b*1 relative to a center of rotational trajectory (axis of rotation) O2 of the engaging pin 63*a*. Therefore, after the engaging pin 63*a* located as illustrated with a broken line in FIG. 8A returns to an initial position illustrated with a two-dot chain line, the axis of the engaging pin 63*a* is located on a central line L2 of the sensor filler 63, that is the drive gear 43, in the vertical direction. This makes it easier to set a rotational reference position of the engaging pin 63*a*.

As long as the engaging pin 63*a* is engaged with the curved groove portion 52*b*1 of the cam groove 52*b*, the slide arm 52 does not reciprocate regardless of any movement of the engaging pin 63*a*. During the engagement of the engaging pin 63*a* with the straight groove portion 52*b*2 of the cam groove 52*b*, the engaging pin 63*a* rotates in a direction where the engagement is retainable, allowing the slide arm 52 to reciprocate in the longitudinal direction thereof.

An auxiliary cam 56 (second auxiliary cam) is provided in a protruding manner on a wall surface of the wall portion 54. The auxiliary cam 56 is located on a central line L2' of the drive gear 43 in the lateral direction. The initial position of the engaging pin 63*a* is set on the central line L2 of the drive gear 43 in the vertical direction, and the auxiliary cam 56 is provided at a position where a central angle is substantially 90° (90°±20°) relative to the initial position. As illustrated in the front view of FIG. 8A, the auxiliary cam 56 is a protrusion where a cam surface 56*a* has a shape of a substantially isosceles-triangle. A height H of the protrusion from the wall portion 54 is set to a value that enables an apex of the triangle to be located substantially on an outer edge of the curved groove portion 52*b*1 of the cam groove 52*b*.

For example, a timing of the engagement between the auxiliary-cam-side engaging pin 63*b*, 63*c* and the auxiliary cam 56 is set as described below. When the slide arm 52 is distant from the initial position during reciprocating, the auxiliary-cam-side engaging pins 63*b* and 63*c* are distant from the auxiliary cam 56. When the slide arm 52 is moved backward to vicinity of the initial position in the reciprocating motion, one of the auxiliary-cam-side engaging pins 63*b* and 63*c* is engaged with the auxiliary cam 56.

Before engaged with the auxiliary cam 56, the auxiliary-cam-side engaging pin 63*b*, 63*c* is engaged with (makes contact with) the wall surface of the wall portion 54. Then, the auxiliary-cam-side engaging pin 63*b*, 63*c*, being guided by the wall surface of the wall portion 54, is engaged with (makes contact with) the cam surface 56*a* corresponding to a side portion of the auxiliary cam 56. Similarly to the wall surface of the wall portion 53, the wall surface of the wall portion 54 has an arc shape having a curvature smaller than that of a circular trajectory drawn by the axis of the auxiliary-cam-side engaging pin 63*b*, 63*c*. By initially making the auxiliary-cam-side engaging pin 63*b*, 63*c* contact with the wall surface of the wall portion 54, the auxiliary-cam-side engaging pin 63*b*, 63*c* is prevented from bumping into the auxiliary cam 56. Accordingly, the auxiliary-cam-side engaging pin 63*b*, 63*c* can make a smooth contact with the cam surface 56*a* of the auxiliary cam 56. Similarly to the wall portion 53, the wall portion 54 serves as a guide wall according to the invention.

Referring to FIG. 7 again, notches 51*c* and 52*c* are formed in lower sections of the slide arms 51 and 52 to avoid any interference with the support pins 31*a* to 35*a*, and stepped portions 51*d* and 52*d* constituting one ends of the notches 51*c* and 52*c* are formed to be engaged with the support pin 35*a*.

Figure 12A:
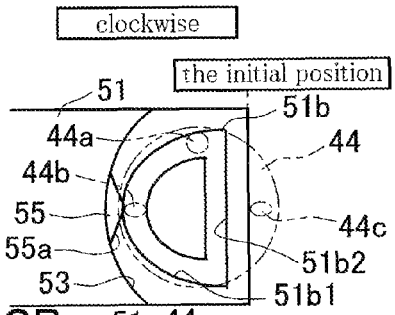
FIGS. 12A to 12F illustrate stages where an engaging pin 44*a* moves from an initial position clockwise on the drawing and arrives at an inverted position.

While thus constructed sheet material punching device is on standby, the electric motor 41 is inactive, and the engaging pins 44*a* and 63*a* and slide arms 51 and 52 are respectively at the initial positions illustrated in FIGS. 7 and 12A.

First, an example in which an array of three holes is formed in the sheet material is described. In the example, when the electric motor 41 on standby is activated, the electric motor 41 is controlled to rotate counterclockwise on the drawing. When the electric motor 41 is rotated counterclockwise on the drawing, the drive gear 43 and the sensor filler 63 are rotated counterclockwise on the drawing, and the drive gear 44 is rotated clockwise on the drawing through an angle equal to the angle as the drive gear 43 has been rotated. At the time, the engaging pin 63*a* moves along the central line of the curved groove portion 52*b*1 of the cam groove 52*b*. Therefore, the slide arm 52 does not reciprocate.

Figure 12B:
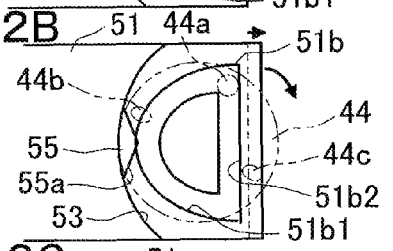

Correspondingly to the rotational position of the engaging pin 44*a* rotating clockwise on the drawing, the straight groove portion 51*b*2 of the cam groove 51*b* starts to be displaced to the right on the drawing as illustrated in FIG. 12B. Then, the slide arm 51 starts to move forward to the right on the drawing, and the links 31, 33, and 35 are thereby respectively rotated clockwise on the drawing about the support pins 31*a*, 33*a*, and 35*a* each serving as a center of rotation. In the state illustrated in FIG. 12A, the auxiliary-cam-side engaging pin 44*b* is in contact with the apex of the auxiliary cam 55, and the auxiliary-cam-side engaging pin 44*b*, together with the engaging pin 44*a*, rotates clockwise on the drawing, gradually away from the auxiliary cam 55. Therefore, the auxiliary-cam-side engaging pin 44*b* does not press the auxiliary cam 55 or restrict the forward movement in the reciprocating motion of the slide arm 51. When the engaging pin 44*a* is rotated clockwise on the drawing through a predefined angle smaller than 90° (for example, 45°), an array of three holes is formed in the sheet material jointly by the punches 21, 23, and 25 and the die holes 11*a*, 11*c*, and 11*e*.

Figure 12C:
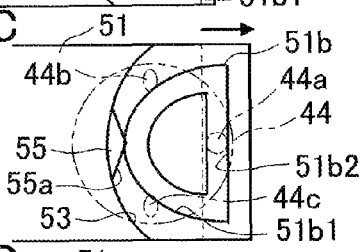
Figure 13A:
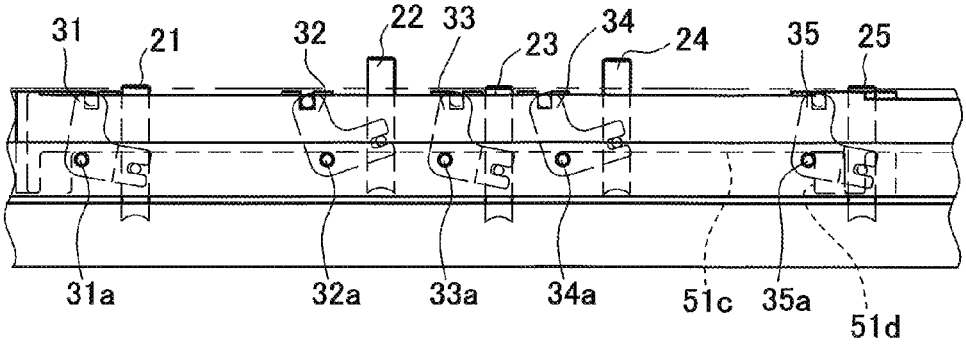
FIG. 13A is an explanatory view of reciprocating motions of punches 21, 23, and 25 in the stage illustrated in FIG. 12C.

As illustrated in FIG. 12C, when the engaging pin 44*a* is rotated clockwise on the drawing through 90°, the forward movement in the reciprocating motion of the slide arm 51 to the right on the drawing is maximized (see FIG. 13A). As the engaging pin 44*a* is further rotated clockwise on the drawing through an angle exceeding 90°, the slide arm 51 starts to move backward, to the left on the drawing. As illustrated in FIG. 12C, when the engaging pin 44*a* is located at an intermediate part of the straight groove portion 51*b*2 of the cam groove 51*b*, the auxiliary-cam-side engaging pins 44*b* and 44*c* are distant from the auxiliary cam 55.

Figure 12D:
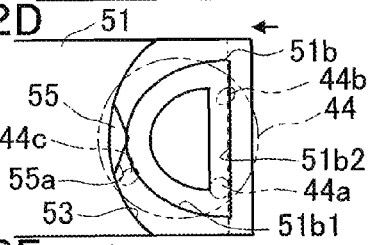

As illustrated in FIG. 12D, when the slide arm 51 is moved backward to vicinity of the initial position, meaning that the engaging pin 44*a* is rotated through an angle of about 130° to 160° clockwise on the drawing from the initial position illustrated in FIG. 12A, the auxiliary-cam-side engaging pin 44*c* makes contact with the wall surface of the wall portion 53. Then, the auxiliary-cam-side engaging pin 44*c*, being guided by the wall surface of the wall portion 53, starts to make contact with the cam surface 55*a* corresponding to a lower side portion of the auxiliary cam 55 as illustrated in the drawing.

Figure 12E:
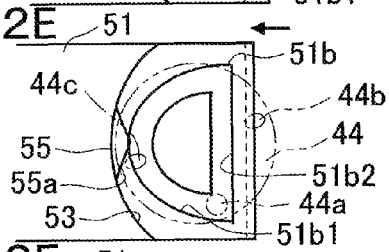
Figure 12F:
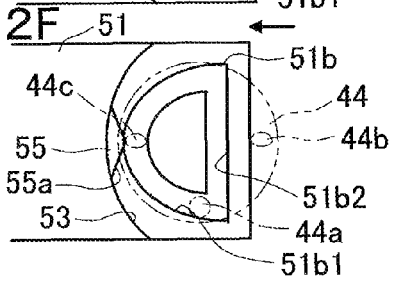

As illustrated in FIGS. 12D and 12E, the auxiliary-cam-side engaging pin 44*c* moves toward the apex of the auxiliary cam 55, thereby pressing the slide arm 51 toward the initial position using the auxiliary cam 55. As illustrated in FIG. 12F, when the engaging pin 44*a* arrives at the inverted position, the auxiliary-cam-side engaging pin 44*c* is in contact with the apex of the auxiliary cam 55 (similar to the state illustrated in FIG. 12A), and the slide arm 51 returns to the initial position.

Figure 12G:
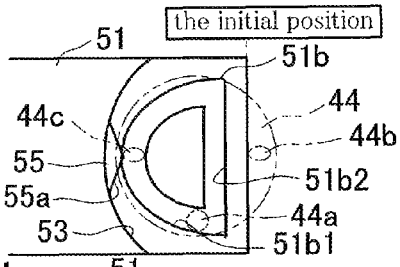
FIGS. 12G to 12L illustrate stages where the engaging pin 44*a* moves from the initial position clockwise on the drawing and arrives at the inverted position.
Figure 12H:
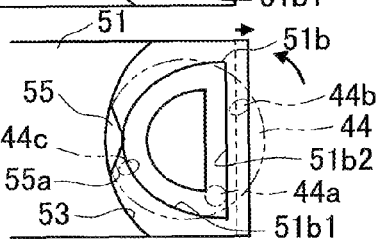
Figure 12I:
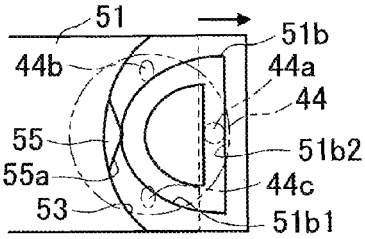

When the three-hole punching is continuously performed, the engaging pin 44*a* at the inverted position illustrated in FIG. 12G is rotated counterclockwise through 180° as illustrated in FIGS. 12H to 12L, and then the illustrations of FIGS. 12A to 12L are carried out. Based on detection signals detected by the home position sensor 62 and the sensor filler 63, a direction of rotation and an angle of rotation of the drive gear 43 are calculated, and whether the engaging pin 44*a* is at the initial position or the inverted position is determined and stored by an electric controller.

In the state illustrated in FIG. 12G, the auxiliary-cam-side engaging pin 44*c* is in contact with the apex of the auxiliary cam 55, and the auxiliary-cam-side engaging pin 44*c*, together with the engaging pin 44*a*, rotates counterclockwise on the drawing, gradually away from the auxiliary cam 55. Therefore, the auxiliary-cam-side engaging pin 44*c* does not press the auxiliary cam 55 or restrict the forward movement in the reciprocating motion of the slide arm 51.

Figure 12J:
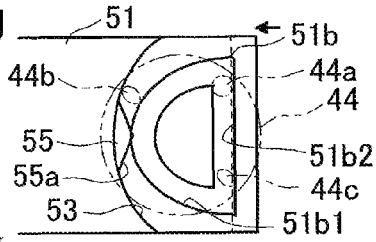

As illustrated in FIG. 12J, when the slide arm 51 is moved backward to vicinity of the initial position, meaning that the engaging pin 44*a* is rotated through an angle of about 130° to 160° counterclockwise on the drawing from the inverted position illustrated in FIG. 12G, the auxiliary-cam-side engaging pin 44*b* makes contact with the wall surface of the wall portion 53. Then, the auxiliary-cam-side engaging pin 44*b*, being guided by the wall surface of the wall portion 53, starts to make contact with the cam surface 55*a* corresponding to an upper side portion of the auxiliary cam 55 as illustrated in the drawing.

Figure 12K:
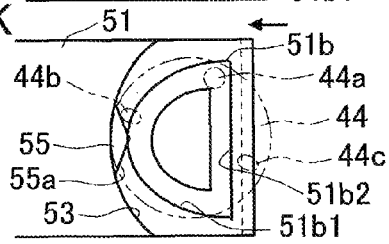
Figure 12L:
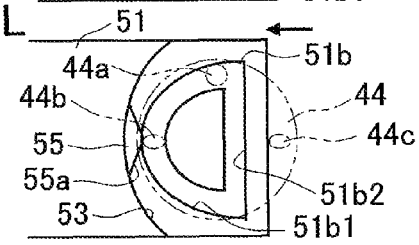

As illustrated in FIGS. 12K and 12L, the auxiliary-cam-side engaging pin 44*b* moves toward the apex of the auxiliary cam 55, thereby pressing the slide arm 51 toward the initial position using the auxiliary cam 55. As illustrated in FIG. 12L, when the engaging pin 44*a* is returned to the initial position illustrated in FIG. 12A, the auxiliary-cam-side engaging pin 44*b* is in contact with the apex of the auxiliary cam 55 (similar to the state illustrated in FIG. 12A), and the slide arm 51 returns to the initial position.

Figure 14A:
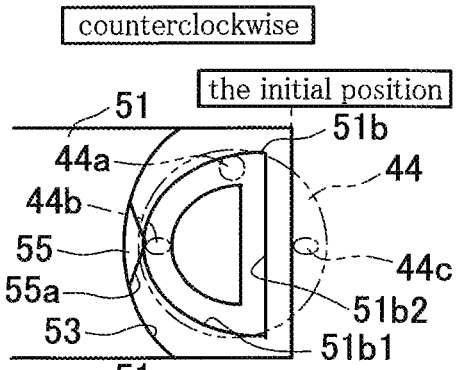
FIGS. 14A to 14E illustrate stages where the engaging pin 44*a* moves from the initial position counterclockwise on the drawing and arrives at the inverted position.
Figure 14B:
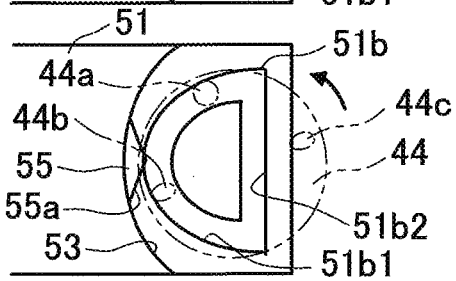
Figure 14C:
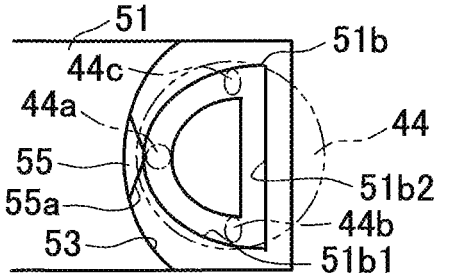
Figure 14D:
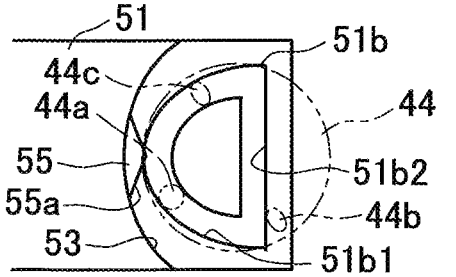
Figure 14E:
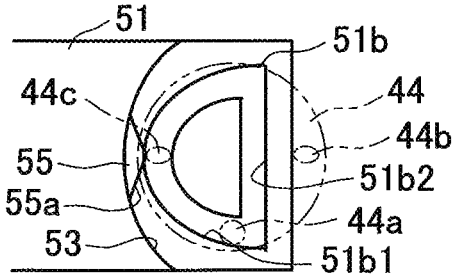

Next, an example in which an array of two holes is formed in the sheet material is described. In the example, the electric motor 41 on standby as illustrated in FIGS. 7 and 14A is activated and controlled to rotate clockwise on the drawing. When the electric motor 41 is rotated clockwise on the drawing, the drive gear 43 and the sensor filler 63 are rotated clockwise on the drawing, and the drive gear 44 is rotated counterclockwise on the drawing through an angle equal to the angle as the drive gear 43 has been rotated. At the time, the engaging pin 44*a* moves along the central line of the curved groove portion 51*b*1 of the cam groove 51*b* as illustrated in FIGS. 14B to 14E. Therefore, the slide arm 51 does not reciprocate.

In the state illustrated in FIG. 14A, the auxiliary-cam-side engaging pin 44*b* is in contact with the apex of the auxiliary cam 55, and the auxiliary-cam-side engaging pin 44*b*, together with the engaging pin 44*a*, rotates counterclockwise on the drawing, gradually away from the auxiliary cam 55. Therefore, the auxiliary-cam-side engaging pin 44*b* does not press the auxiliary cam 55 or move the slide arm 51 backward.

During the counterclockwise rotation of the engaging pin 44*a*, the slide arm 51 does not reciprocate. Therefore, when the engaging pin 44*a* is then moved to the inverted position illustrated in FIG. 14E, the auxiliary-cam-side engaging pin 44*c* merely makes contact with the apex of the auxiliary cam 55. Therefore, the auxiliary-cam-side engaging pin 44*c* does not press the auxiliary cam 55 or move the slide arm 51 backward.

Figure 15A:
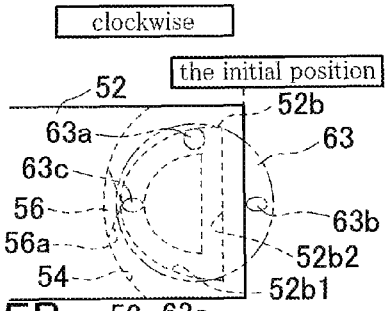
FIGS. 15A to 15F illustrate stages where an engaging pin 63*a* moves from an initial position clockwise on the drawing and arrives at an inverted position.
Figure 15B:
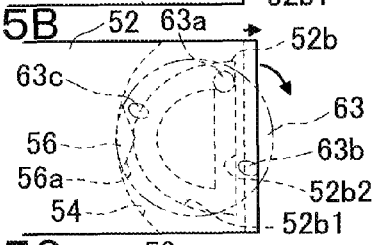

Correspondingly to the rotational position of the engaging pin 63*a* rotating clockwise on the drawing, the straight groove portion 52*b*2 of the cam groove 52*b* starts to be displaced to the right on the drawing as illustrated in FIG. 15B. Then, the slide arm 52 starts to move forward to the right on the drawing, and the links 32 and 34 are thereby rotated clockwise on the drawing about the support pins 32*a* and 34*a* each serving as a center of rotation.

In the state illustrated in FIG. 15A, the auxiliary-cam-side engaging pin 63*c* is in contact with the apex of the auxiliary cam 56, and the auxiliary-cam-side engaging pin 63*c*, together with the engaging pin 63*a*, rotates clockwise on the drawing, gradually away from the auxiliary cam 56. Therefore, the auxiliary-cam-side engaging pin 63*c* does not press the auxiliary cam 56 or restrict the forward movement in the reciprocating motion of the slide arm 52. When the engaging pin 63*a* is rotated clockwise on the drawing through a predefined angle smaller than 90° (for example, 45°), an array of two holes is formed in the sheet material jointly by the punches 22 and 24 and the die holes 11*b* and 11*d*.

Figure 13B:
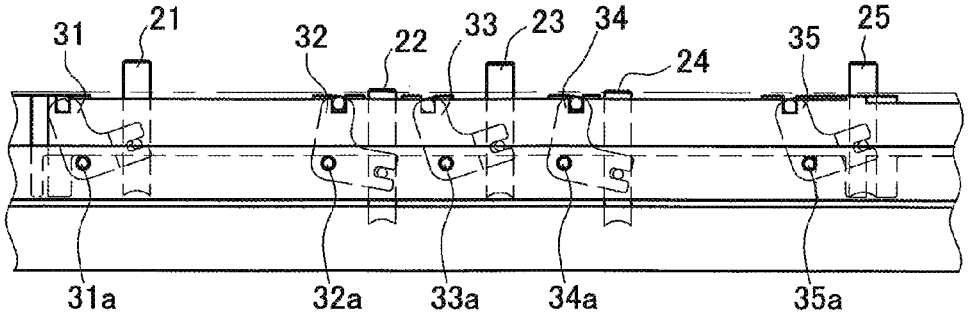
FIG. 13B is an explanatory view of reciprocating motions of punches 22 and 24 in a stage illustrated in FIG. 15C.
Figure 15C:
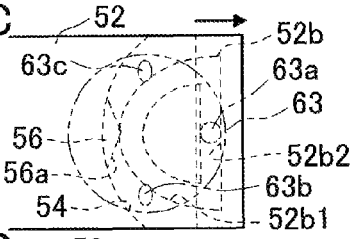

As illustrated in FIG. 15C, when the engaging pin 63*a* is rotated clockwise on the drawing through 90°, the forward movement in the reciprocating motion of the slide arm 52 to the right on the drawing is maximized (see FIG. 13B). As the engaging pin 63*a* is further rotated clockwise on the drawing through an angle exceeding 90°, the slide arm 52 starts to move backward, to the left on the drawing. As illustrated in FIG. 15C, when the engaging pin 63*a* is located at an intermediate part of the straight groove portion 52*b*2 of the cam groove 52*b*, the auxiliary-cam-side engaging pins 63*b* and 63*c* are distant from the auxiliary cam 56.

Figure 15D:
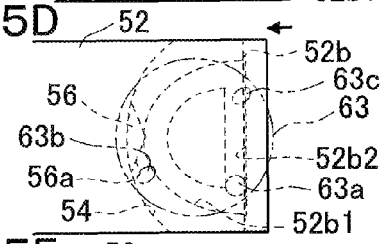

As illustrated in FIG. 15D, when the slide arm 52 is moved backward in the reciprocating motion to vicinity of the initial position, meaning that the engaging pin 63*a* is rotated through an angle of about 130° to 160° clockwise on the drawing from the initial position illustrated in FIG. 15A, the auxiliary-cam-side engaging pin 63*b* makes contact with the wall surface of the wall portion 54. Then, the auxiliary-cam-side engaging pin 63*b*, being guided by the wall surface of the wall portion 54, starts to make contact with the cam surface 56*a* corresponding to a lower side portion of the auxiliary cam 56 as illustrated in the drawing.

Figure 15E:
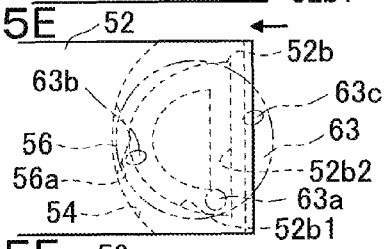
Figure 15F:
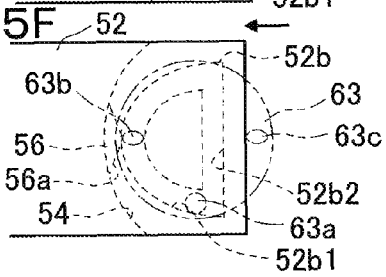

As illustrated in FIGS. 15D and 15E, the auxiliary-cam-side engaging pin 63*b* moves toward the apex of the auxiliary cam 56, thereby pressing the slide arm 52 toward the initial position using the auxiliary cam 56. As illustrated in FIG. 15F, when the engaging pin 63*a* arrives at the inverted position, the auxiliary-cam-side engaging pin 63*b* is in contact with the apex of the auxiliary cam 56 (similar to the state illustrated in FIG. 15A), and the slide arm 52 returns to the initial position.

Figure 15G:
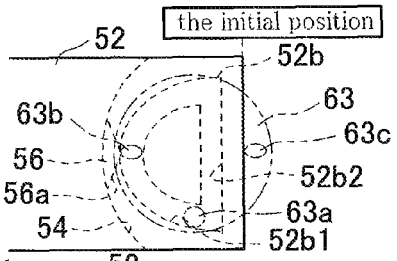
FIGS. 15G to 15L illustrate stages where the engaging pin 63*a* moves from the inverted position counterclockwise on the drawing and arrives at the initial position.
Figure 15H:
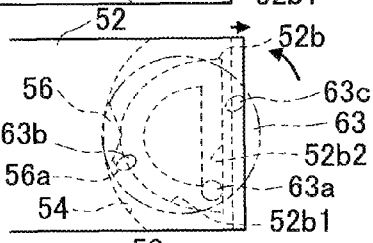
Figure 15I:
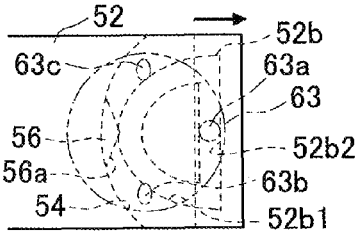

When the two-hole punching is continuously performed, the operation of the electric motor 41 is controlled so that the engaging pin 63*a* at the inverted position illustrated in FIG. 15G is rotated counterclockwise through 180° as illustrated in FIGS. 15H to 15L.

In the state illustrated in FIG. 15G, the auxiliary-cam-side engaging pin 63*b* is in contact with the apex of the auxiliary cam 56, and the auxiliary-cam-side engaging pin 63*b*, together with the engaging pin 63*a*, rotates counterclockwise on the drawing, gradually away from the auxiliary cam 56. Therefore, the auxiliary-cam-side engaging pin 63*b* does not press the auxiliary cam 56 or restrict the forward movement in the reciprocating motion of the slide arm 52.

Figure 15J:
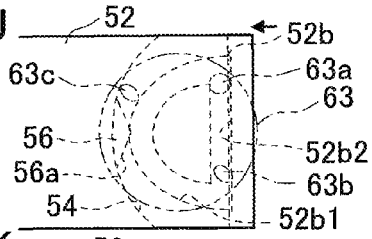

As illustrated in FIG. 15J, when the slide arm 52 is moved backward to vicinity of the initial position, meaning that the engaging pin 63*a* is rotated through an angle of about 130° to 160° counterclockwise on the drawing from the inverted position illustrated in FIG. 15G, the auxiliary-cam-side engaging pin 63*c* makes contact with the wall surface of the wall portion 54. Then, the auxiliary-cam-side engaging pin 63*c*, while being guided by the wall surface of the wall portion 54, starts to make contact with the cam surface 56*a* corresponding to an upper side portion of the auxiliary cam 56 as illustrated in the drawing.

Figure 15K:
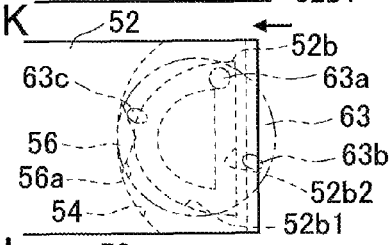
Figure 15L:
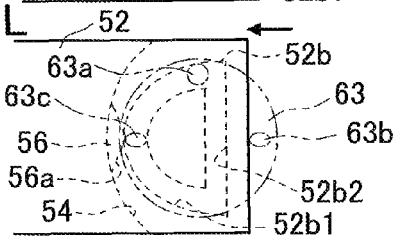

As illustrated in FIGS. 15K and 15L, the auxiliary-cam-side engaging pin 63*c* moves toward the apex of the auxiliary cam 56, thereby pressing the slide arm 52 toward the initial position using the auxiliary cam 56. As illustrated in FIG. 15L, when the engaging pin 63*a* is returned to the initial position illustrated in FIG. 15A, the auxiliary-cam-side engaging pin 63*c* is in contact with the apex of the auxiliary cam 56 (similar to the state illustrated in FIG. 15A), and the slide arm 52 returns to the initial position.

According to the first embodiment, the engagement between the auxiliary cam 55 (56) and the auxiliary cam follower 44*b*, 44*c* (63*b*, 63*c*) converts the rotational motion of the driving mechanism constituted by the electric motor 41, the drive gear 44 (43) and the like into the backward movement in the reciprocating motion of the slide arm 51 (52). As a result, the slide arm 51 (52) returns to the predefined initial position (position corresponding to the initial position or the inverted position of the engaging pin 44*a* (63*a*) as illustrated in FIGS. 12A, 12F, and 12L (FIGS. 15A, 15F, and 15L)). By thus leveraging the rotational motions of the electric motor 41, the drive gear 44 (43) and the like to return the slide arm 51 (52) to the initial position, it becomes unnecessary to provide a biasing member to return so.

This reduces a driving load required for the reciprocating motion of the slide arm 51 (52), thereby effectively preventing the driving energy of the driving source from increasing. Another advantage is that the combination of the auxiliary cam 55 (56) and the auxiliary cam follower 44*b*, 44*c* (63*b*, 63*c*) constitutes the mechanism for returning the slide arm 51 (52) to the initial position. Such a mechanism can be structurally simplified and inexpensively provided.

According to the first embodiment, the auxiliary cam followers 44*b* and 44*c* (63*b* and 63*c*) are provided at positions of point symmetry (diagonal positions) with respect to the axis of rotation O1 (O2) of the drive gear 44 (43). This ensures that the slide arm 51 (52) returns to the initial position not only when the cam-side engaging pin 44*a* (63*a*) moves toward the initial position but also when the cam-side engaging pin 44*a* (63*a*) moves toward the inverted position. As a result, the punching operation of the punches is accurately performed. One of the auxiliary cam followers, auxiliary cam 44*c* (63*b*), can be omitted.

According to the first embodiment, the slide arm 51 (52) is provided with the wall portion 53 (54) serving as a guide wall that guides the auxiliary-cam-side engaging pins 44*b* and 44*c* (63*b* and 63*c*) to the cam surface 55*a* (56*a*) corresponding to a side portion of the auxiliary cam 55 (56). However, the wall portion 53 (54) can be omitted.

According to the first embodiment, the sensor filler 63 is provided with the cam-side engaging pin 63*a* and the auxiliary-cam-side engaging pins 63*b* and 63*c*. As an alternative option, at least one of the cam-side engaging pin and the auxiliary-cam-side engaging pins may be provided in the drive gear 43. As another alternative option, at least one of the cam-side engaging pins and the auxiliary-cam-side engaging pins may be provided in a rotary member that rotates integrally with the drive gear 44 (for example, sensor filler).

Second Embodiment

According to the first embodiment, one cam-side engaging pin 44*a* (63*a*) is provided in the drive gear 44 (sensor filler 63). Referring to a slide arm 151 and a drive gear 144 illustrated in FIG. 16, the cam-side engaging pins 44*a* and 44*d* may be provided at positions of point symmetry (diagonal positions) with respect to an axis of rotation O1 of the drive gear 144. Any other configurations are similar to those of the first embodiment. The similar structural elements and any portions that function similar to those of the first embodiment will not be described in detail again, with the same reference symbols simply given thereto.

The cam-side engaging pins 44*a* and 44*d* and the auxiliary-cam-side engaging pins 44*b* and 44*c* are located on a circumference centering on the axis of rotation O1. Based on the clockwise direction of the axis of rotation O1 in front view of the inner-side surface of the drive gear 44 (see FIG. 11), the auxiliary-cam-side engaging pin 44*b* is located at a position having a phase advanced through 90° relative to the cam-side engaging pin 44*a*, whereas the auxiliary-cam-side engaging pin 44*c* is located at a position having a phase delayed through 90° relative to the same.

On the other hand, the auxiliary-cam-side engaging pin 44*c* is located at a position having a phase advanced through 90° relative to the cam-side engaging pin 44*d*, whereas the auxiliary-cam-side engaging pin 44*b* is located at a position having a phase delayed through 90° relative to the same.

Figure 16:
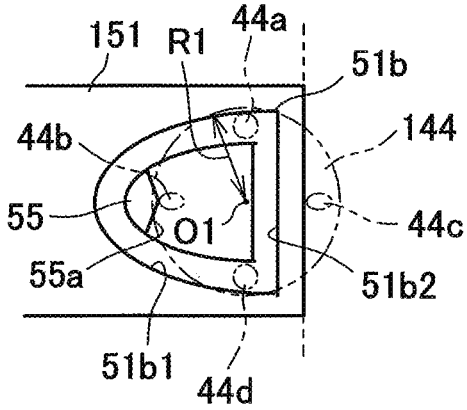
FIG. 16 is a partial front view of a slide arm 151 and a drive gear 144 in a sheet material punching device according to the second embodiment of the invention.

Similarly to the first embodiment, the slid arm 151 has a cam groove 51*b* in a width slightly larger than the diameter of the engaging pin 44*a* as illustrated in the front view of FIG. 16. Further, the cam groove 51*b* is formed in a substantially reversed D-like shape constituted by a curved groove portion 51*b*1 and a straight groove portion 51*b*2. In contrast to the first embodiment, a radius of curvature of a central line of the curved groove portion 51*b*1 of the cam groove 51*b* (first arm operation restricting portion) is set larger than a radius of rotation R1 of a circular trajectory drawn by the axis of the engaging pin 44*a* (a shape in which the substantially reversed D-like shape is deformed).

Figure 17A:
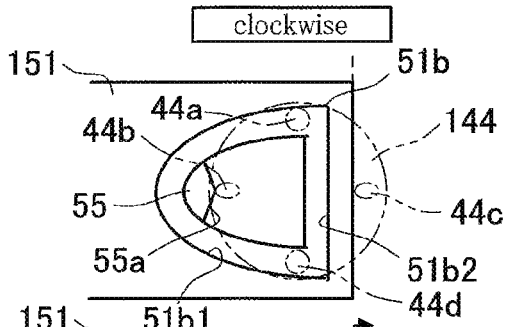
FIGS. 17A to 17F illustrate stages where an engaging pin 44*a* of the slide arm 151 of FIG. 16 rotates from an initial position clockwise on the drawing through 180°.

More specifically, as illustrated in FIG. 17A and the like, the radius of curvature of the curved groove portion 51*b*1 is set to a predefined value that enables to avoid any interference with the circular trajectory drawn by the axis of the engaging pin 44*a* when the slide arm 151 is reciprocating with the engaging pin 44*a* being engaged with the straight groove portion 51*b*2 of the cam groove 51*b*. As a matter of course, any interference of the curved groove portion 51*b*1 with the engaging pin 44*a* is prevented when the slide arm 151 is reciprocating with the engaging pin 44*d* being engaged with the straight groove portion 51*b*2 of the cam groove 51*b* (see FIG. 18A). The slide arm 151 and the drive gear 144 according to the second embodiment allow the slide arm 151 to reciprocate regardless of the direction in which the drive gear 144 is rotated, clockwise (see FIG. 17A) or counterclockwise (see FIG. 18A) on the drawing.

An auxiliary cam 55 (first auxiliary cam) is provided in a protruding manner on an inner-side portion surrounded by the curved groove portion 51*b*1 of the cam groove 51*b*. Similarly to the first embodiment, the auxiliary cam 55 is a protrusion including a cam surface 55*a* of a substantially isosceles-triangle shape. According to the second embodiment, the slide arm 151 is not provided with a wall portion serving as a guide wall in view of the shape of the curved groove portion 51*b*1.

By using the slide arm 151 and the drive gear 144 thus configured in combination with the slide arm 52 and the sensor filler 63 according to the first embodiment, an array of three holes or an array of five holes can be formed in the sheet material depending on the rotational direction of the electric motor 41. To form an array of three holes in the sheet material, the electric motor 41 on standby as illustrated in FIGS. 7 and 17A is activated and controlled to rotate counterclockwise on the drawing. When the electric motor 41 is rotated counterclockwise on the drawing, the drive gear 43 and the sensor filler 63 are rotated counterclockwise on the drawing, and the drive gear 144 is rotated clockwise on the drawing through an angle equal to the angle as the drive gear 43 has been rotated. At the time, the engaging pin 63*a* moves along the central line of the curved groove portion 52*b*1 of the cam groove 52*b*. Therefore, the slide arm 52 does not reciprocate.

Figure 17B:
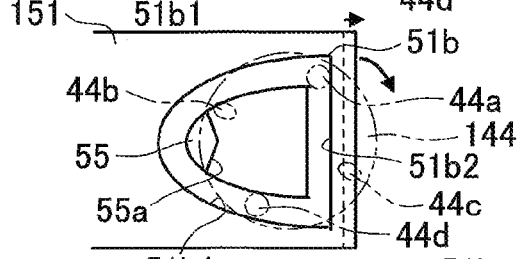

Correspondingly to the rotational position of the engaging pin 44*a* rotating clockwise on the drawing, the straight groove portion 51*b*2 of the cam groove 51*b* starts to be displaced to the right on the drawing as illustrated in FIG. 17B. Then, the slide arm 151 starts to move forward to the right on the drawing, and the links 31, 33, and 35 are thereby rotated clockwise on the drawing about the support pins 31*a*, 33*a*, and 35*a* each serving as a center of rotation. In the state illustrated in FIG. 17A, the auxiliary-cam-side engaging pin 44*b* is in contact with the apex of the auxiliary cam 55, and the auxiliary-cam-side engaging pin 44*b*, together with the engaging pin 44*a*, rotates clockwise on the drawing, gradually away from the auxiliary cam 55. Therefore, the auxiliary-cam-side engaging pin 44*b* does not press the auxiliary cam 55 or restrict the forward movement in the reciprocating motion of the slide arm 151. When the engaging pin 44*a* is rotated clockwise on the drawing through a predefined angle smaller than 90° (for example, 45°), an array of three holes is formed in the sheet material jointly by the punches 21, 23, and 25 and the die holes 11*a*, 11*c*, and 11*e*.

Figure 17C:
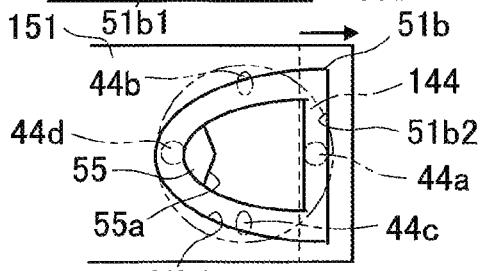
Figure 17D:
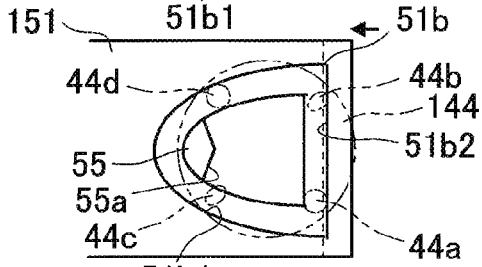

As illustrated in FIG. 17C, when the engaging pin 44*a* is rotated clockwise on the drawing through 90°, the forward movement in the reciprocating motion of the slide arm 151 to the right on the drawing is maximized. As the engaging pin 44*a* is further rotated clockwise on the drawing through an angle exceeding 90°, the slide arm 151 starts to move backward, to the left on the drawing. As illustrated in FIG. 17C, when the engaging pin 44*a* is located at an intermediate part of the straight groove portion 51*b*2 of the cam groove 51*b*, the auxiliary-cam-side engaging pins 44*b* and 44*c* are distant from the auxiliary cam 55.

Figure 17E:
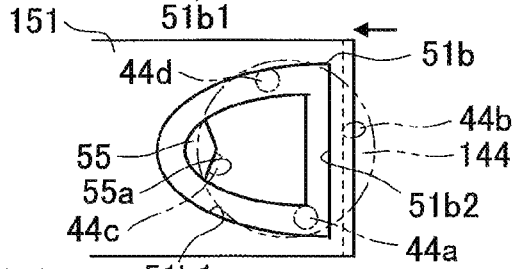

As illustrated in FIG. 17E, when the slide arm 151 is moved backward to vicinity of the initial position, meaning that the engaging pin 44*a* is rotated through an angle of about 130° to 160° clockwise on the drawing from the initial position illustrated in FIG. 17A, the auxiliary-cam-side engaging pin 44*c* starts to make contact with the cam surface 55*a* corresponding to a lower side portion of the auxiliary cam 55 as illustrated in the drawing.

Figure 17F:
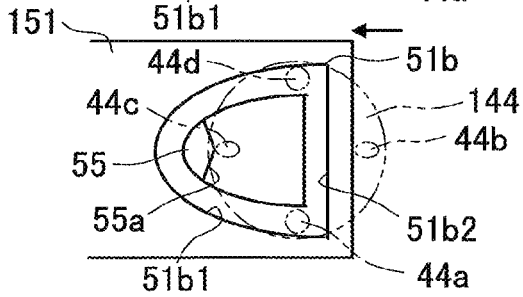

As illustrated in FIG. 17F, the auxiliary-cam-side engaging pin 44*c* moves toward the apex of the auxiliary cam 55, thereby pressing the slide arm 151 toward the initial position using the auxiliary cam 55. When the engaging pin 44*a* arrives at the inverted position, the auxiliary-cam-side engaging pin 44*c* is in contact with the apex of the auxiliary cam 55 (similar to the state illustrated in FIG. 17A), and the slide arm 151 returns to the initial position.

When the three-hole punching is continuously performed, the engaging pin 44*a* at the inverted position illustrated in FIG. 17F is further rotated clockwise through 180°, meaning that the illustrations in FIGS. 17A to 17F are carried out. When the sheet material punching device according to the first embodiment continuously performs the three-hole punching, it is necessary that the engaging pin 44*a* be rotated (inverted) counterclockwise through 180° for each punching. When the slide arm 151 and the drive gear 144 according to the second embodiment are used, the drive gear 144 is simply rotated clockwise continuously. This greatly facilitates the operation of the electric motor 41.

Figure 18A:
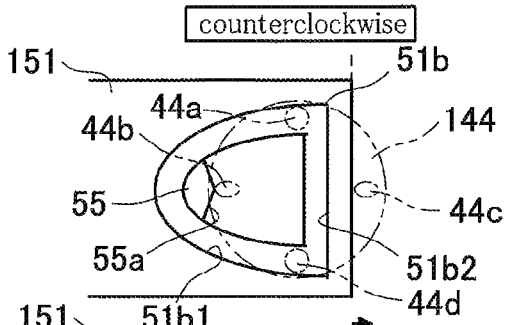
FIGS. 18A to 18F illustrate stages where an engaging pin 44*d* of the slide arm 151 of FIG. 16 rotates from an inverted position counterclockwise on the drawing through 180°.

To form an array of five holes in the sheet material, the electric motor 41 on standby as illustrated in FIGS. 7 and 18A is controlled to rotate clockwise on the drawing. When the electric motor 41 is rotated clockwise on the drawing, the drive gear 43 and the sensor filler 63 are rotated clockwise on the drawing, and the drive gear 144 is rotated counterclockwise on the drawing through an angle equal to the angle the drive gear 43 has been rotated. At the time, the engaging pin 44*d* moves along the central line of the straight groove portion 51*b*2 of the cam groove 51*b*, and the engaging pin 63*a* moves along the central line of the straight groove portion 52*b*2 of the cam groove 52*b*. Therefore, the slide arm 151 and the slide arm 52 both reciprocate.

Figure 18B:
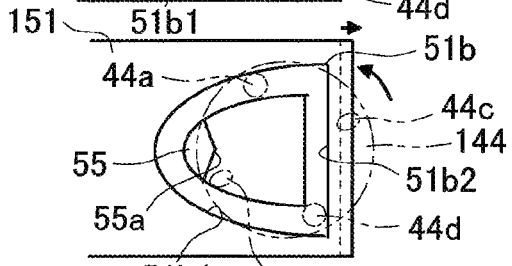

More specifically, the straight groove portion 51*b*2 of the cam groove 51*b* starts to be displaced to the right on the drawing correspondingly to the rotational position of the engaging pin 44*d* rotating counterclockwise on the drawing as illustrated in FIG. 18B. Accordingly, the slide arm 151 starts to move forward to the right on the drawing, and the links 31, 33, and 35 are thereby rotated clockwise on the drawing respectively about the support pins 31*a*, 33*a*, and 35*a* each serving as a center of rotation. At the same time, the straight groove portion 52*b*2 of the cam groove 52*b* starts to be displaced to the right on the drawing correspondingly to the rotational position of the engaging pin 63*a* rotating clockwise on the drawing. Accordingly, the slide arm 52 starts to move forward to the right on the drawing as illustrated in FIGS. 15A to 15L, and the links 32 and 34 are thereby rotated clockwise on the drawing respectively about the support pins 32*a* and 34*a* each serving as a center of rotation.

In the state illustrated in FIG. 18A, the auxiliary-cam-side engaging pin 44*b* is in contact with the apex of the auxiliary cam 55, and the auxiliary-cam-side engaging pin 44*b*, together with the engaging pin 44*d*, rotates counterclockwise on the drawing, gradually away from the auxiliary cam 55. Therefore, the auxiliary-cam-side engaging pin 44*b* does not press the auxiliary cam 55 or restrict the forward movement in the reciprocating motion of the slide arm 151. When the engaging pin 44*d* is rotated counterclockwise on the drawing through a predefined angle smaller than 90° (for example, 45°) and the engaging pin 63*a* is rotated clockwise as illustrated in FIGS. 15A to 15L through a predefined angle smaller than 90° (for example, 45°), an array of five holes is formed in the sheet material jointly by the punches 21 to 25 and the die holes 11*a* to 11*e*.

Figure 18C:
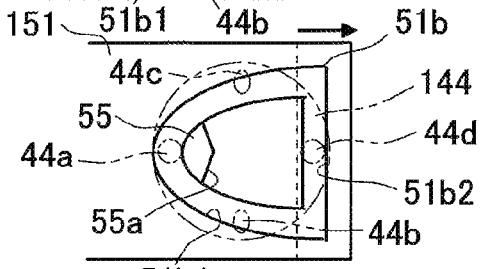
Figure 18D:
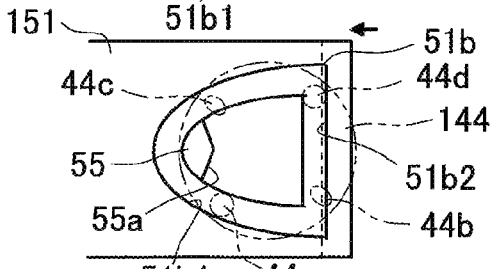

As illustrated in FIG. 18C, when the engaging pin 44*d* is rotated counterclockwise on the drawing through 90°, the clockwise forward movement in the reciprocating motion of the slide arm 151 to the right on the drawing is maximized. As the engaging pin 44*d* is further rotated counterclockwise on the drawing through an angle exceeding 90°, the slide arm 151 starts to move backward, to the left on the drawing. As illustrated in FIG. 18C, when the engaging pin 44*d* is located at an intermediate part of the straight groove portion 51*b*2 of the cam groove 51*b*, the auxiliary-cam-side engaging pins 44*b* and 44*c* are distant from the auxiliary cam 55.

Figure 18E:
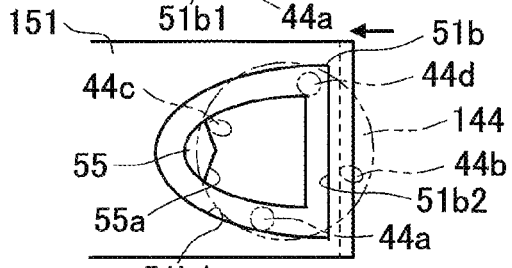

As illustrated in FIG. 18E, when the slide arm 151 is moved backward to vicinity of the initial position, meaning that the engaging pin 44*d* is rotated through an angle of about 130° to 160° counterclockwise on the drawing from the initial position illustrated in FIG. 18A, the auxiliary-cam-side engaging pin 44*c* starts to make contact with the cam surface 55*a* corresponding to an upper side portion of the auxiliary cam 55 as illustrated in the drawing.

Figure 18F:
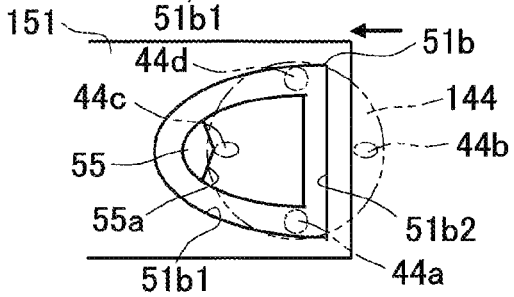

As illustrated in FIG. 18F, the auxiliary-cam-side engaging pin 44*c* moves toward the apex of the auxiliary cam 55, thereby pressing the slide arm 151 toward the initial position using the auxiliary cam 55. When the engaging pin 44*d* at the initial position illustrated in FIG. 18A arrives at the inverted position illustrated in FIG. 18F, the auxiliary-cam-side engaging pin 44*c* is in contact with the apex of the auxiliary cam 55 (in the state illustrated in FIG. 18A), and the slide arm 151 returns to the initial position.

When the five-hole punching is continuously performed, the engaging pin 44*d* at the inverted position illustrated in FIG. 18F is further rotated counterclockwise through 180°, meaning that the illustrations in FIGS. 18A to 18F are carried out. That is, the drive gear 144 is continuously rotated counterclockwise.

Figure 19:
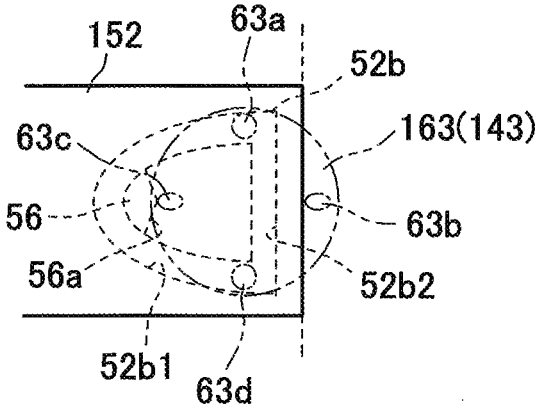
FIG. 19 is a partial front view of a slide arm 152 and a sensor filler 163 (drive gear 143) in a sheet material punching device according to a modified embodiment of the second embodiment.
Figure 20A:
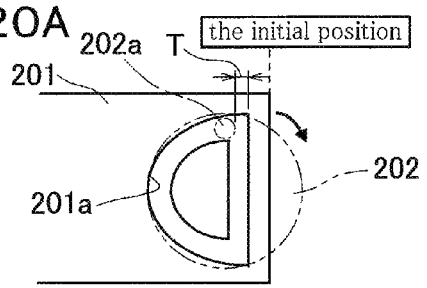
FIGS. 20A to 20E illustrate stages where a cam follower rotates from an initial position clockwise on the drawing through 180° in a conventional sheet material punching device having no biasing member.
Figure 20B:
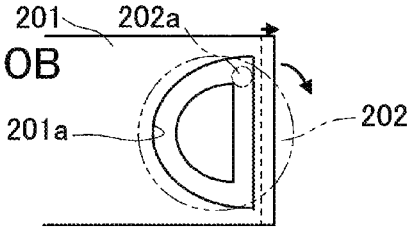
Figure 20C:
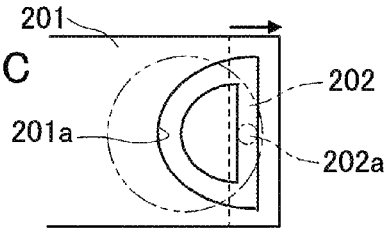
Figure 20D:
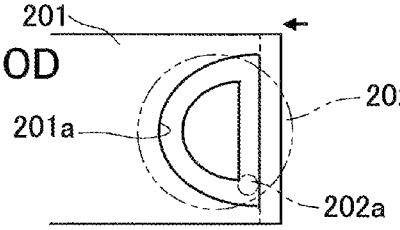
Figure 20E:
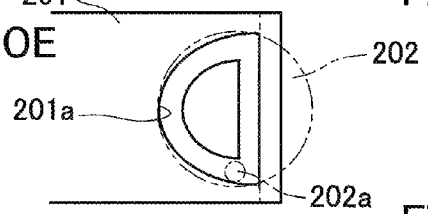
Figure 20F:
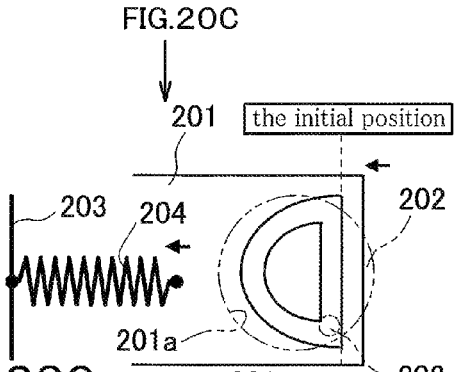
FIGS. 20F to 20H illustrate stages where a reciprocating slide arm has returned to vicinity of an initial position (the cam follower has rotated to vicinity of an inverted position) in a conventional sheet material punching device provided with a biasing member.
Figure 20G:
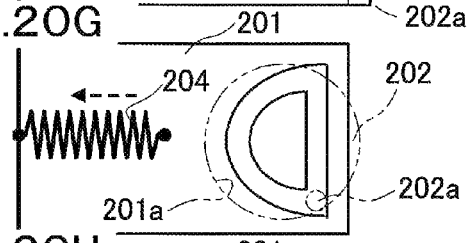
Figure 20H:
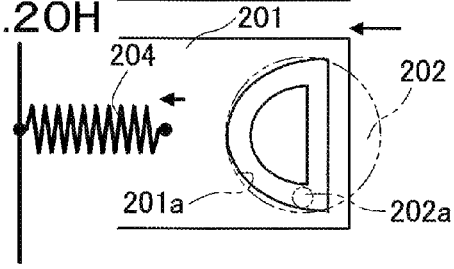

According to the second embodiment, the cam-side engaging pins located at diagonal positions and the cam grooves formed in the deformed reversed D-like shape to be engaged with these cam-side engaging pins are applied to the slide arm 51 and the drive gear 44 to obtain the slide arm 151 and the drive gear 144. As illustrated in FIG. 19, such cam-side engaging pins and cam grooves may be applied to the slide arm 52 and the sensor filler 63 (or the drive gear 43) to obtain a slide arm 152 having a cam groove 52*b* formed in the deformed reversed D-like shape and a sensor filler 163 (or a drive gear 143) having cam-side engaging pins 63*a* and 63*d*.

By using the slide arm 152 and the sensor filler 163 (or the drive gear 143) thus configured, an array of two holes or an array of five holes can be formed in the sheet material depending on the rotational direction of the electric motor 41. Any other configurations are similar to those of the first embodiment. The similar structural elements and any portions that function similar to those of the first embodiment will not be described in detail again, with the same reference symbols simply given thereto.

In place of two slide arms used in the first and second embodiments, one slide arm or three or more slide arms may be used.

The shape of the cam groove is not necessarily limited to the substantially D-like shape or the substantially reversed D-like shape, but may be a shape having portions that respectively function as an arm operating portion and an arm operation restricting portion.

According to the first and second embodiments, the links are provided so that timings of punching by the punches are substantially equal. However, the positions of the links coupled with the slide arms (the points where power is applied) may be differed in the respective punches so that the timings of punching by the respective punches are not coincident with one another. Thus configured, the timings of punching by the respective punches can be made different from one another in a more simplified and facilitated manner than those by changing the cam profiles or by changing the support positions of the links to the frame body (rotational centers). This effectively reduces a punching load of each punch.

According to the first and second embodiments, the invention is applied to the sheet material punching device wherein the plurality of punches are reciprocated in the punching direction by the intermediary of the plurality of links as the slide arm reciprocates. The invention is further applicable to sheet material punching devices wherein punches are not link-driven, for example, a device wherein cam grooves are formed in slide arms to make punching pins directly reciprocate, a device wherein slide arms per se constitute cams, and a device wherein rack gears are provided in slide arms to make punches reciprocate while being rotated.

According to the first and second embodiments, the invention is applied to the sheet material punching device used in a finisher. The invention is further applicable to sheet material punching devices used in, for example, printers.

DESCRIPTION OF REFERENCE SYMBOLS

12 frame
21-25 punch
31-35 link
40 driving mechanism
41 electric motor (driving source)
43, 44, 143, 144 drive gear
44*a*, 44*d*, 63*a*, 63*d* cam-side engaging pin
44*b*, 44*c*, 63*b*, 63*c* auxiliary-cam-side engaging pin
51, 52, 151, 152 slide arm
51*b*, 52*b* cam groove
51*b*1, 52*b*1 curved groove portion
51*b*2, 52*b*2 straight groove portion
55, 56 auxiliary cam
63, 163 sensor filler (rotary member)

The invention claimed is:

1. A sheet material punching device, comprising:

a plurality of punches provided in a longitudinal direction of a frame;

a driving mechanism having a drive gear capable of transmitting a rotational driving force of a driving source;

a slide arm allowed to reciprocate along the longitudinal direction of the frame, the slide arm making the plurality of punches reciprocate in a punching direction along with a reciprocating motion of the slide arm;

a cam provided in the slide arm and capable of converting a rotational motion of the driving mechanism into the reciprocating motion of the slide arm;

a cam follower provided in the drive gear or a rotary member that rotates integrally with the drive gear to be engaged with the cam;

an auxiliary cam provided in the slide arm, the auxiliary cam being capable of moving the slide arm to a predefined initial position by converting the rotational motion of the driving mechanism into a backward movement in the reciprocating motion of the slide arm; and an auxiliary cam follower provided in the drive gear or the rotary member that rotates integrally with the drive gear to be engaged with the auxiliary cam.

2. The sheet material punching device according to claim 1, wherein the cam is a grooved cam having a cam groove formed in a substantially D-like shape or a substantially reversed D-like shape in which D is laterally reversed, the cam follower is a cam-side engaging pin engaging with the cam groove, a straight groove portion that is a structural element of the cam groove formed in the substantially D-like shape or the substantially reversed D-like shape functions as an arm operating portion that converts the rotational motion of the driving mechanism into the reciprocating motion of the slide arm by an intermediary of the cam-side engaging pin, and a curved groove portion that is a structural element of the cam groove formed in the substantially D-like shape or the substantially reversed D-like shape functions as an arm operation restricting portion that does not convert the rotational motion of the driving mechanism into the reciprocating motion of the slide arm, the curved groove portion having an arc shape in which a radius of curvature of a central line is set equal to a radius of rotation of a circular trajectory drawn by an axis of the cam-side engaging pin.

3. The sheet material punching device according to claim 2, wherein the auxiliary cam is a protrusion where an auxiliary cam surface has a shape of a substantially isosceles-triangle in a front view of the slide arm, the auxiliary cam follower is an auxiliary-cam-side engaging pin engageable with the auxiliary cam, the auxiliary-cam-side engaging pin starts to be engaged with the auxiliary cam surface corresponding to a side portion of the auxiliary cam on a base-angle side thereof when the slide arm is moved backward in the reciprocating motion to vicinity of the initial position, and the auxiliary-cam-side engaging pin presses the slide arm toward the initial position using the auxiliary cam as the auxiliary-cam-side engaging pin further moves toward an apex of the auxiliary cam.

4. The sheet material punching device according to claim 3, wherein the slide arm is provided with a guide wall that guides the auxiliary-cam-side engaging pin to the auxiliary cam surface corresponding to a side portion of the auxiliary cam before the auxiliary-cam-side engaging pin is engaged with the auxiliary cam.

5. The sheet material punching device according to claim 1, wherein the cam is a grooved cam having a cam groove formed in a substantially D-like shape or a substantially reversed D-like shape in which D is laterally reverted, the cam follower is a cam-side engaging pin engageable with the cam groove, the cam-side engaging pin being provided at each of positions of point symmetry with respect to an axis of rotation of the drive gear or the rotary member that rotates integrally with the drive gear, a straight groove portion that is a structural element of the cam groove formed in the substantially D-like shape or the substantially reversed D-like shape functions as an arm operating portion that converts the rotational motion of the driving mechanism into the reciprocating motion of the slide arm by an intermediary of the cam-side engaging pin, and a curved groove portion that is a structural element of the cam groove formed in the substantially D-like shape or the substantially reversed D-like shape has a curvature set to a predefined value that enables to avoid any interference with a circular trajectory drawn by an axis of one of the cam-side engaging pins when the slide arm is reciprocating with the other cam-side engaging pin being engaged with the straight groove portion.

6. The sheet material punching device according to claim 5, wherein the auxiliary cam is a protrusion where an auxiliary cam surface has a shape of a substantially isosceles-triangle in a front view of the slide arm, the auxiliary cam being provided in a protruding manner on an inner-side portion surrounded by the cam groove, the auxiliary cam follower is an auxiliary-cam-side engaging pin engageable with the auxiliary cam, the auxiliary-cam-side engaging pin makes contact with the auxiliary cam surface corresponding to a side portion of the auxiliary cam on a base-angle side when the slide arm is moved backward in the reciprocating motion to vicinity of the initial position, and the auxiliary-cam-side engaging pin presses the slide arm toward the initial position using the auxiliary cam as the auxiliary-cam-side engaging pin further moves toward an apex of the auxiliary cam.

7. The sheet material punching device according to claim 3, wherein the auxiliary cam follower is provided at each of positions of point symmetry with respect to an axis of rotation of the drive gear or the rotary member that rotates integrally with the drive gear.

8. The sheet material punching device according to claim 6, wherein the auxiliary cam follower is provided at each of positions of point symmetry with respect to an axis of rotation of the drive gear or the rotary member that rotates integrally with the drive gear.

9. The sheet material punching device according to claim 2, wherein a plurality of the slide arms is used, and an array of holes to be formed by the plurality of punches is changed by switching the reciprocating motion of one of the slide arms to the reciprocating motion of the other.

10. The sheet material punching device according to claim 5, wherein a plurality of the slide arms is used, and an array of holes to be formed by the plurality of punches is changed by switching the reciprocating motion of one of the slide arms to the reciprocating motion of the other.

* * * * *